US010159297B2

(12) United States Patent
Jamison

(10) Patent No.: US 10,159,297 B2
(45) Date of Patent: Dec. 25, 2018

(54) PATTERNED PLEXUS OF FILAMENTS, METHOD OF PRODUCING AND ARTICLES CONTAINING PATTERNED FILAMENTS

(71) Applicant: Bradford C. Jamison, Warrensburg, NY (US)

(72) Inventor: Bradford C. Jamison, Warrensburg, NY (US)

( * ) Notice: Subject to any disclaimer, the term of this patent is extended or adjusted under 35 U.S.C. 154(b) by 383 days.

(21) Appl. No.: 14/061,210

(22) Filed: Oct. 23, 2013

(65) Prior Publication Data

US 2014/0377488 A1 Dec. 25, 2014

Related U.S. Application Data

(60) Provisional application No. 61/825,614, filed on May 21, 2013, provisional application No. 61/830,589, filed on Jun. 3, 2013.

(51) Int. Cl.

| | |
|---|---|
| ***A43B 1/04*** | (2006.01) |
| ***A43B 23/04*** | (2006.01) |
| ***D04C 1/10*** | (2006.01) |

(52) U.S. Cl.

CPC ..... *A43B 1/04* (2013.01); *A43B 23/042* (2013.01); *D04C 1/10* (2013.01);

(Continued)

(58) Field of Classification Search

CPC ..... A43B 23/04; A43B 23/042; A43B 1/04; A43B 1/10; D04C 1/10; D10B 2501/043; Y10T 428/1362; Y10T 428/249921

See application file for complete search history.

(56) References Cited

U.S. PATENT DOCUMENTS

D22,553 S * 6/1893 Frelloehr ..... D5/47
1,057,477 A * 4/1913 Brindle ..... D03D 41/002 139/419

(Continued)

FOREIGN PATENT DOCUMENTS

CN 2153951 Y 1/1994
EP 0243119 B1 1/1991

(Continued)

OTHER PUBLICATIONS

Braid Runner,Joel Salamin, Jul. 3, 2013, http://www.coroflot.com/joel_salamin/BraidRunner.

(Continued)

*Primary Examiner* — Kevin R Kruer

(57) ABSTRACT

Disclosed herein is a plexus of filaments which is composed of groups of filaments, whose filament members are linked together, in a repetitious pattern, and whose filaments may be interlaced or linked to bisecting groups of filaments, creating a patterned plexus whose filament members generally follow spiraling paths, while linking with neighboring filaments, creating a group, or interlaced groups, of tension distributive filaments within a plexus of filaments; said plexus exhibiting greater conformal and constrictive qualities in comparison to the prior art. Also disclosed is a method of producing filament structures for a variety of uses including composite structures with tension displacement properties, and sporting goods requiring conformal load distribution with minimal weight; such as, running shoes.

5 Claims, 25 Drawing Sheets

(52) U.S. Cl.
CPC ... *D10B 2501/043* (2013.01); *Y10T 428/1362* (2015.01); *Y10T 428/249921* (2015.04)

(56) References Cited

U.S. PATENT DOCUMENTS 1,554,325 A 10/1924 Bente
1,527,344 A 2/1925 Bente
1,583,273 A 5/1926 Bosebeck
1,885,749 A 1/1932 Mehler
1,887,643 A 11/1932 Huber
D95,349 S 4/1935 Horwitz
2,022,350 A 11/1935 Huber
D116,386 S * 8/1939 Sigoda ..... D5/47
D118,205 S * 12/1939 Carragher et al. ..... D5/47
2,188,640 A 1/1940 Bloch
RE21,392 E 3/1940 Hurwit
4,550,511 A 11/1985 Gamm
4,719,837 A 1/1988 McConnell et al.
4,987,848 A * 1/1991 Todd ..... G09F 17/00 116/173
5,001,961 A 3/1991 Spain
5,111,760 A 5/1992 Garzone, Jr.
5,351,352 A 10/1994 Chillemi
5,357,839 A 10/1994 Brookstien et al.
5,899,134 A * 5/1999 Klein ..... D04C 1/00 87/13
6,854,296 B1 * 2/2005 Miller, III ..... D04B 1/123 66/190
7,293,371 B2 11/2007 Aveni
7,350,321 B2 4/2008 Soon et al.
7,444,768 B2 11/2008 Friton
7,546,698 B2 6/2009 Meschter
7,555,847 B2 7/2009 Kendall
7,637,032 B2 12/2009 Sokolowski et al.
7,703,220 B2 4/2010 Aveni
7,938,853 B2 * 5/2011 Chouinard ..... A61F 2/90 623/1.15
8,028,440 B2 10/2011 Sokolowski et al.
8,037,621 B2 10/2011 Hooper
D685,195 S * 7/2013 Maier ..... D5/58
8,490,299 B2 7/2013 Dua
8,757,038 B2 6/2014 Siegismund
8,859,088 B2 * 10/2014 Broughton, Jr. ..... E04C 3/28 264/258
2002/0022875 A1 * 2/2002 Strecker ..... A61F 2/90 623/1.15
2002/0157429 A1 * 10/2002 Matsumoto ..... D04B 21/02 66/195
2003/0089000 A1 5/2003 Tseng
2004/0235799 A1 * 11/2004 Siren ..... A61K 31/7024 514/120
2005/0193592 A1 9/2005 Dua et al.
2006/0058862 A1 * 3/2006 Dong ..... A61F 2/06 623/1.5
2007/0144221 A1 * 6/2007 Sytz ..... D04B 1/18 66/171
2012/0255201 A1 10/2012 Little
2013/0047467 A1 2/2013 Roether et al.
2013/0051706 A1 2/2013 Roether et al.
2013/0051709 A1 2/2013 Roether et al.
2013/0051712 A1 2/2013 Roether et al.
2013/0305465 A1 * 11/2013 Siegismund ..... A43B 9/12 12/146 C
2014/0373389 A1 12/2014 Bruce
2015/0007451 A1 1/2015 Bruce
2015/0201707 A1 7/2015 Bruce
2018/0020762 A1 1/2018 Jamison

FOREIGN PATENT DOCUMENTS

EP 2667741 A1 12/2013
WO 2012166244 A1 12/2012

OTHER PUBLICATIONS

Wikipedia,Bobbinet; https://en.wikipedia.org/wiki/Bobbinet.
Bridget M Cook, Geraldine Stott; The Book of Bobbin Lace Stitches; Dover Publications, Inc. Mineola, New York, 1980; 300 Pages, (pp. 13, 15).
Chandler Robbins Clifford; The Lace Dictionary; Clifford & Lawton, Publishers, 1 East Twenty-Eighth Street, New York, 1913; 156 Pages (pp. 72.103,104,105,106).

* cited by examiner

PATTERNED PLEXUS OF FILAMENTS, METHOD OF PRODUCING AND ARTICLES CONTAINING PATTERNED FILAMENTS

CROSS-REFERENCE TO RELATED APPLICATIONS

This application claims priority from U.S. Provisional Patent Applications 61/825,614, filed on May 21, 2013, and 61/830,589, filed on Jun. 3, 2013, the disclosures of which are included by reference herein in their entirety.

BACKGROUND OF THE INVENTION

1. Technical Field

The present invention generally relates to filament networks or a patterned plexus of filaments, such as, woven fabrics, and the articles that can be fabricated with filament networks, such as, footwear, apparel, accessories, sporting goods, and equipment; more particularly, the present invention relates to multi-axial filament networks comprising linked and interwoven strands, which provide enhanced flexibility and endurance to the plexus of strands, and the articles that can be fabricated with the multi-axial filament networks, such as, footwear, apparel, accessories, sporting goods, and equipment, having enhanced performance, flexibility, structural qualities, and endurance.

2. Description of Related Art

The art of weaving and braiding of yarns and/or threads has a long and storied history. The basic concept of interlacing, typically at right angles, has origins in pre-recorded history. Through the centuries, weaving and braiding, among other interlacing practices, and weaving and braiding machines and methods have developed and continue to develop wherein weaving and braiding are integral processes in the present day manufacture of apparel and other articles.

However, advances in technology and advances in the use of that technology have brought recognition in the art of the limits of conventional weaving and braiding methods. For example, as recognized by the present inventor, conventional means of weaving and braiding of yarns, threads, and other filamentous material can yield less than ideal products, especially, due to the non-conforming nature of woven and braided filaments, which typically rely on friction and filament proximities to retain filament network uniformity. Prior art weaves and braids typically have a dense filament structure, where the close proximity of other filaments within the structure is what primarily keeps the filaments or strands of filaments from becoming displaced within the network of filaments. It is, in part, the dense filament structure which disallows conformity of prior art fabrics around irregular or complex shapes. Another limitation in prior art weaves and braids is due to the primarily linear, taunt nature of the filaments within a plexus. Typically woven and braided fabrics are made up of two perpendicular groups of parallel filaments, wherein the filaments which make up the two groups are interwoven or interlaced together, thus the plexus created by woven and braided material is generally limited to two axial semi-rigid tension constraints. The constraint which the two groups of parallel filaments lend to a plexus of filaments is considered to be a semi-rigid constraint due to the primarily linear nature of the filaments within the plexus, and because; all of the filaments within a plexus function as singular filaments, and not as a coefficient unified plexus, which is to say that displacing one strand within a plexus is possible without transferring that displacement force throughout the plexus, ie. one strand could be pulled from a weave or braid without significantly pulling, or tensioning any other strands within the plexus. The fact that the filaments in prior art weaves and braids act as individuals and not as a coefficient plexus can lend excessive stresses to individual filaments. Another drawback in prior art filament structures is filament displacement; since filaments in either axial group are not interconnected to other filaments in their respective groups, it is easy to displace filaments or groups of filaments within the plexus of filaments, particularly if the plexus is loosely woven or braided; as it is sometimes desired. Another inherent problem with woven and braided fibers, particularly when used in structural composite applications, is the bending of the filaments as they bend in order to travel past bisecting filaments; this bending of the filaments at every intersection point between the bisecting filaments, produces undesirable weakness within a plexus of filaments. Aspects of the present invention overcome these and other deficiencies and disadvantages of the prior art.

Among other articles of apparel, the development of footwear, in particle, high performance athletic footwear, has recently introduced the use of woven materials, for example, to enhance the durability of the footwear, reduce the weight, and/or enhance moisture release, among other reasons. As known in the art, the upper portion of footwear (for example, the portion known in the art as the "upper") has been known to introduce woven structures. U.S. Pat. Nos. 7,293,371; 7,444,768; 7,546,698; and 8,028,440 represent some examples of the use of woven structures in footwear. Typically, the upper is mounted and secured to the sole of the footwear, where the sole provides the interface with the ground or floor.

However, the inventor has found that the typical prior art means of securing the upper to the sole exhibits several limitations. For instance, in the prior art, adequately securing a typically soft and pliable upper with a relatively harder and more rigid sole may be difficult and expensive. As known in the art, and to most every footwear wearer, this interface or seam between the upper and the sole is often not only a path for unwanted elements (such as, water) to enter the footwear but may also be the earliest location where failure—that is, rips and tears—typically occur.

In addition, prior means of securing the upper to the sole typically include structures of the upper that engage relatively perpendicularly with the sole. As also recognized by wearers, the relatively perpendicular engagement of the upper to the sole typically prevents the upper from following the contour of the foot resulting in separation between the upper and the foot near or adjacent the engagement of the upper with the sole. This resulting separation of the foot from the upper may typically be an area of relative movement between the foot and the upper that can result in increased friction between the foot and the upper and consequent wear of the upper and sores and blisters on the foot. Again, aspects of the present invention address these and other disadvantages of conventional footwear design and construction.

Though aspects of the present invention may be uniquely suited to the disadvantages and limitations of prior art footwear design and construction, aspects of the present invention also address the disadvantages and limitations of a broad range of article design and construction, including, but not limited to, furniture, sporting goods, apparel, accessories, protective gear, and fiber-reinforced composite structures, including, tubes, rods, bars, plates, and sheets, among other structures and structural components.

SUMMARY OF THE INVENTION

Aspects of the present invention provide filament structures and articles made from filament structures, for example, clothing, furniture, footwear, rope, wire and cable, and sporting goods, having improved performance compared to the prior art. For example, the filament structures disclosed herein may provide greater flexibility, greater endurance, and greater conformability than prior art filament structures. Specifically, with regard to footwear and related applications, aspects of the present invention provide for enhanced distribution of loading (for example, tensile loading) and thus reduced localized loading, for example, upon a foot, while providing enhanced conformably to the article engaged, for example, enhanced conformability and comfort for the wearer of the footwear.

One embodiment of the present invention is a plexus of filaments comprised of at least two groups of filaments, wherein a plurality of filaments which is defined as a group of filaments, are all directed adjacent to neighboring filaments within the group, and wherein at least some of the plurality of filaments within a group of filaments engage other adjacent filaments by linking to them along their length's a plurality of times within a patterned plexus of filaments, and wherein; each group of adjacent filaments, interlace with filaments which make up the other bisecting groups of filaments. A narrowed definition of the embodiment above would be a plexus of filaments which is comprised of two groups of filaments, wherein one of the filament groups lie on the 0 degree axis and the bisecting group of filaments lie on the 90 degree axis, and wherein the paths that the filaments within a group travel are definable as helices and further defined as helices which are linked a plurality of times along their length, and are interlaced with the filaments which lie in the perpendicular bisecting axis. The terms "linking" and "interlacing" according to aspects of the invention are discussed in the detailed description of the drawings.

In an alternative arrangement of a plexus of filaments which is comprised of groups of filaments that are linked to filaments within their respective group, there are at least some filaments which are also linked to members of a bisecting axial group of filaments. Another alternative arrangement would allow for a plexus of filaments which is comprised of two or more groups of adjacent filaments, where some filaments which define a group of filaments, are not interlaced with other adjacent filaments within their axial group.

Regarding a method of creating a plexus of filaments on a programmable machine, wherein the machine would have a planer or tubular surface upon which carriers travel in direction, distance and defined intervals. Disposed upon and drawn from the carriers would be spools of filaments. Filaments could also be drawn through a planer or tubular surface, from spools located beneath the surface to which the carriers travel. The patterned movements of the carriers, by the machine, while filaments are being drawn from spools, allow for the creation of a plexus of filaments as described as the present invention. The method to create a patterned plexus of filaments upon a machine would be to program the machine to direct carriers to cross in front and behind other carriers, subsequently interlacing or linking other filaments. More specifically, the method to create a patterned plexus of filaments on a programmable machine would be to program two or more groups of carriers, whose group members all travel adjacent to neighboring carriers within the group, and whose paths cross in front and behind neighboring carriers, thus linking the filaments which are drawn from the spools. The different groups of carriers would be programmed to travel in bisecting paths and could be programmed to interlace with other strands by traveling in front of one carrier from an opposed group of carriers and behind another carrier from an opposed group of carriers, thus interlacing the groups of filaments. It would be beneficial to note for the sake of clarity, that if the carriers traveled along extensively circular paths around the surface of a machine, such as a circular lace braiding machine, and the paths to which groups of carriers extensively traveled were clockwise and counterclockwise, the paths would continuously bisect each other along a radial axis, and form a tubular plexus of filaments. Alternatively, if the paths of the carriers around the machine were all directed to stop at a defined location and change directions continuing the same pattern but in the opposed direction to which they were traveling, a plexus of filaments would be formed that was not tubular, and whose filament members traveled back and forth between either side of what would be considered a flat tape or fabric.

Also noteworthy, with regard to programmable circular lace braiding machines, would be the ability to program the paths to which the carriers travel around a machine, to be continuous and discontinuous, which is to say; not travel all the way around the machine for a period of time and reverse direction, continuing a pattern of linking and interlacing filaments around only a portion of the machine, and then return to a pattern of going all the way around a machine, thus creating a hole along the length of a substantially tubular plexus of filaments; such holes being useful within the production of footwear, to create an opening to receive a foot, for instance.

Another note with regard to programmable circular braiding machines, would be the ability to have groups of carriers which travel in three bisecting directions; a first direction being clockwise, a second direction being counterclockwise and a third direction being longitudinal or stationary, which the other two groups would bisect. The members of each group could all be linked together creating three unified groups of filaments whose members could also be linked or interlaced to filaments in other groups thus creating a trilateral group of linked and/or interlaced filaments. Another way of creating a trilateral plexus of filaments would be to have three groups of filaments; again, one going clockwise, a second going counterclockwise, and a third group which; instead of being drawn from spools located on carriers; would be drawn from the other side of the surface to which the carriers travel upon, in between the points where carriers cross paths. This configuration would effectively allow additional filaments to become linked and interlaced with the other two filament groups. An advantage to drawing filaments through openings in the surface(s) to which carriers travel, would be the ability to increase the number of filaments a given machine could draw into a plexus, by one third.

Another aspect of the invention lies within the method unto which a plexus is formed, and the paths to which filaments travel throughout the plexus, those filament paths being specifically definable as helices which link neighboring filaments, all of which form a plexus of spiraling filaments. The spiraling filaments are produced within the plexus by the paths to which the carriers travel around the surface of a machine. The path of any given carrier, in order to create a spiraling filament, must always be traveling in a particular direction around other filaments; clockwise for instance. This, by virtue of the circular path a carrier travels around another carrier, creates a filament which spirals around a filament located to one side of the length and then another filament located on the other side of the length of that particular filament, thus creating a spiraling linked filament. If all the filaments within a plexus are linked together in this fashion, a linked plexus will result; wherein, tension placed upon any of the filaments is able to be transmitted throughout the plexus, by virtue of the linking of the strands. The transmission of tension is created as one linked filament transfers tension to a linked filament and then that filament can transfer the tension placed upon it by the first filament to another filament, and so forth and so on.

Another aspect of a plexus of filaments as described herein as the present invention is the ability of a filament structure to distribute loads equally amongst the all the filaments within the structure, would be the production of a human body resting devise wherein there lies a tubular or flat plexus of filaments, which is tensioned around a frame. The advantage of such a devise would be to not only provide a breathable mesh, but also to comfortably distribute the load from pressure points which engage the material, which would then improve circulation at typical pressure points on a human body while at rest.

One embodiment of the invention includes or comprises groups of filaments wherein the filaments which define a group of filaments all lie adjacent to one another, and wherein at least one of groups of axial filaments comprises a plurality of filaments, wherein at least some of the plurality of filaments within the stated group of plurality of filaments engages at least one other filament by linking to it along the length of the plexus of filaments a plurality of times, and wherein; said group of plurality of filaments engage the other axial groups of filaments which lie on a bisecting axis by interlacing.

One embodiment of the invention is a method of fabricating an article of footwear, the method including or comprising the forming of a hollow; upper portion of a foot encompassing structure that is designed to secure a user's foot to a sole. The hollow structure comprising of a plexus of filaments which at least consists of a substantial area within the plexus where there are two or more groups of filaments, each of which contains a plurality of filaments, which are all directed adjacent to neighboring filaments, and wherein a plurality of filaments within a group of filaments engage other adjacent filaments by linking to them a plurality of times, within a patterned plexus of filaments, and wherein; said group or plurality of filaments engage the other axial group of filaments which lie on a bisecting axis by interweaving.

A further embodiment of the invention is footwear or an upper portion of footwear which includes or is comprised of an upper portion which includes a filament structure substantially disposed across the longitudinal axis of the upper; and a sole structure mounted to the upper.

A further embodiment of the invention is an article of footwear including or comprising an upper portion which includes a filament structure substantially disposed across the longitudinal axis of the upper; and a sole structure mounted to the upper. In one aspect, the method of patterning a plexus of filaments may include or comprise a plexus of filaments which at least consists of a substantial area within the plexus where there are groups of filaments, wherein, a plurality of filaments which are defined as a group of filaments, are all directed adjacent to neighboring filaments, and wherein a plurality of filaments within a group of filaments engage other adjacent filaments by linking to them a plurality of times, within a patterned plexus of filaments, and wherein; said group of plurality of filaments engage the other axial group of filaments which lie on a bisecting axis by interlacing. Furthermore, a third axial group of filaments may be included within the linked and interlaced network of filaments, and contain filaments which would be linked to or interlaced with the other two axial groups of filaments. In one aspect, the filament structure may be a tubular structure elongated along the longitudinal axis of the upper, for example, a tubular filament structure fabricated from a circular lace-braiding machine. The article of footwear may be athletic footwear, dress footwear, casual footwear, work footwear, safety footwear, or any footwear disclosed herein.

A still further embodiment of the invention is a method of fabricating an article of footwear having a filament structure. The method may include or comprise braiding, linking and interlacing a plurality of filaments to form an elongated, hollow, filament structure; and mounting the elongated, hollow filament structure to a sole structure. In one aspect, the method may further comprise expanding the elongated, hollow, filament structure to a desired expanded dimension, for example, by mounting the elongated, hollow, filament structure on a mandrel having the desired expanded dimension.

Another embodiment of the invention is a method of fabricating an article of footwear, the method including or comprising the forming of a substantially tubular structure by fabricating a plexus of filaments, wherein, the tubular structure is patterned to have a sole interfacing portion. The sole interfacing portion can be secured to the sole in a variety of ways, one of which would be to integrally mold portions of the plexus of filaments of the tubular structure which lie under the pressure points of a user's foot, and wherein, a portion of the upper consists of an area where there are groups of filaments, wherein, a plurality of filaments which are defined as a group of filaments, are all directed adjacent to neighboring filaments, and wherein a plurality of filaments within a group of filaments engage other adjacent filaments by linking to them a plurality of times, within a patterned plexus of filaments, and wherein; said group of plurality of filaments engage the other axial group of filaments which lie on a bisecting axis by interlacing.

In one aspect, the method may further include introducing at least one interface element between the sole structure and the upper structure, for example, by at least partially embedding the at least one interface element in the upper structure.

In another aspect, the method may further include providing an opening in the elongated, tubular filament structure adapted to provide an ankle opening for the article of footwear. In a further aspect, the method may further include trimming the elongated, tubular filament structure to a predetermined length.

Another embodiment of the invention is a method of fabricating an article of footwear, the method including or comprising the forming of integral shoelace by interlacing filaments or laces into the hollow elongated structure, which would function as or be replaced by shoelaces.

Another embodiment of the invention is a method of fabricating an article of footwear, the method including or comprising the forming of a hollow; upper portion of a foot encompassing structure that is designed to secure a user's foot to a sole portion. The hollow structure comprising of a plexus of filaments which at least consists of a substantial area within the plexus where there are groups of filaments, wherein, the plurality of filaments which are defined as a group of filaments, are all directed adjacent to neighboring filaments, and wherein the plurality of filaments within a group of filaments engage other adjacent filaments by linking to them a plurality of times, within a patterned plexus of filaments, and wherein; said group of plurality of filaments engage the other axial group of filaments which lie on a bisecting axis by interlacing.

In one aspect, the hollow structure consists of a substantially tubular hollow structure. In another aspect, the two groups of filaments, which lie on bisecting axis, lie on the 0 and 90 degree axis respectively. In a further aspect, there exist a method of engaging a tensioning device around the top of a heel portion of footwear and integrating said tensioning device into an overall tensioning system engaged to secure footwear to a user's foot, and wherein the tensioning device consists of laces that are extended around the heel of a shoe traveling in opposing directions and return to the front of the footwear where they are freely integrated with material either side of a shoe thus being able to constrict material on either side of a shoe around a user's foot. In a still further aspect, the laces or the paths that the lace of a shoe travel are at least partially defined by filaments within a plexus of filaments designed to function as laces or at least the partial paths the laces are desired to follow are patterned into a filament arrangement designed to be used for binding a foot to a sole. In a further aspect, a portion of the substantially tubular, hollow structure is molded to the sole or inner sole of a shoe at or near the primary pressure points where the bottom of a foot contacts flat surface. In a still further aspect, the points which are molded to a sole or inner sole do not include an area between the area where a heel and the ball of a foot would rest.

Aspects of the present invention may be applied to a broad range of industries and technologies. For example, aspects of the present invention include footwear, apparel, and accessories having one or more of the fiber arrangements disclosed herein; wires and/or cables having one or more of the fiber arrangements disclosed herein, for example, wires which exhibit enhanced sound dampening, vibration dampening, and/or energy transfer compared to the prior art; ropes and cords having one or more the fiber arrangements disclosed herein, for example, ropes and cords having enhanced flexibility, extendibility, and/or strength compared to the prior art; fiber-reinforced structures and materials having the fiber arrangements disclosed herein, for example, "composite" (for example, fiber-reinforced) structures and materials comprising fiber structures having one or more of the filament arrangements disclosed herein, for example, a fiber-reinforced polymer having one or more of the filament arrangements disclosed herein.

These and other aspects, features, and advantages of this invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF ASPECTS OF THE INVENTION

Aspects and details of the present invention comprise filament arrangements, plexus or structures, methods of fabricating filament arrangements or structures, footwear and other articles having one or more filament arrangements, for example, a plurality of filament structures, combined to produce a single filament structure which would be useful in making footwear and other articles. The filament structures may also be used in non-footwear applications, for example, to provide versatile sports accessories, sporting goods, bags, containers, protective clothing, and the like. Aspects of the present invention can also be used in the fabrication or construction of materials, for example, fiber-re-enforced or composite materials, where the filament structures disclosed herein can provide the structural framework upon which a matrix material can be retained.

Figure 1A:
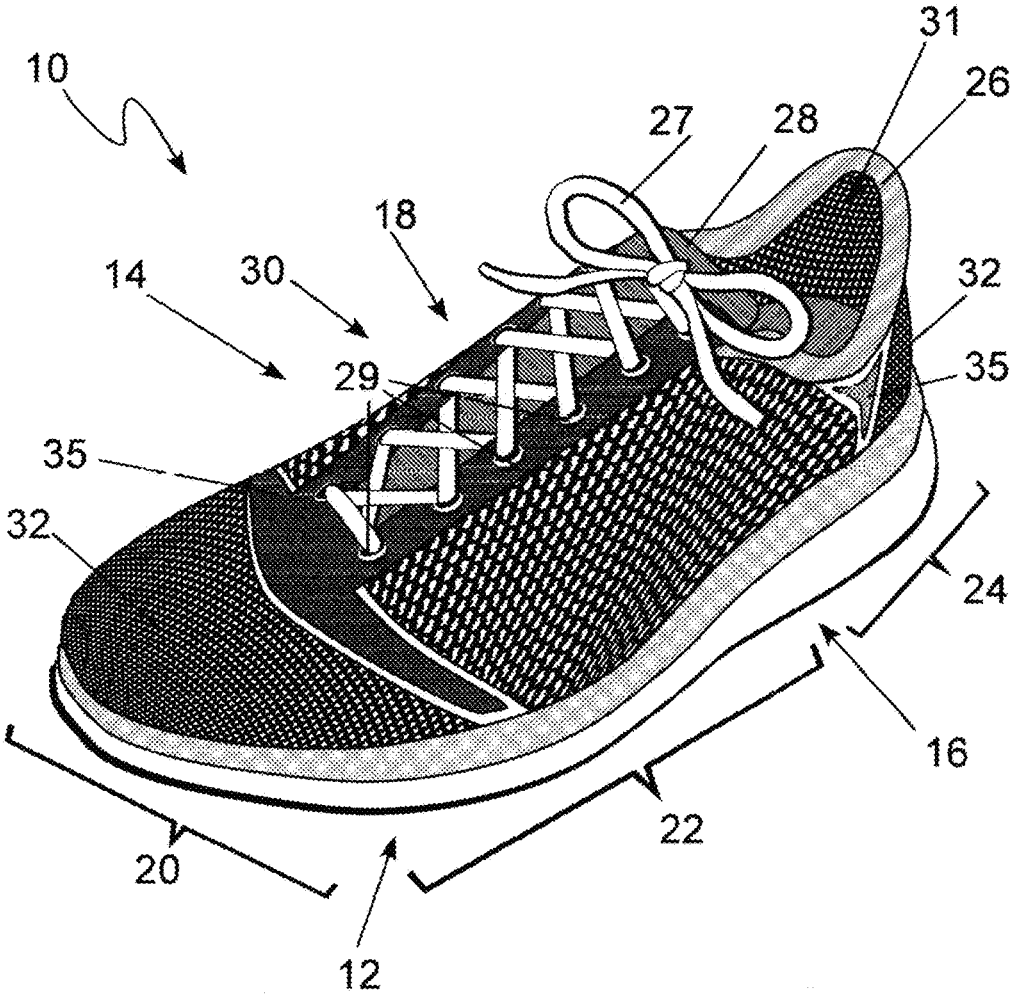
FIG. 1A is a perspective view of an article of footwear, having a filament structure, according to one aspect of the invention.
Figure 1B:
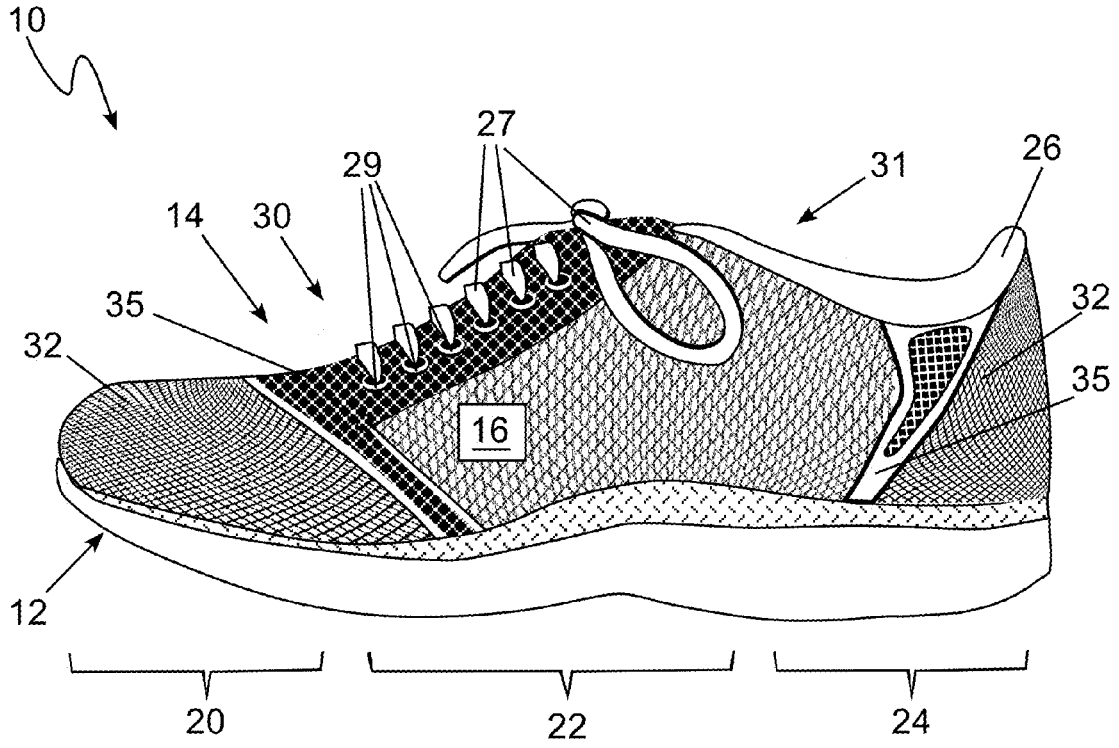
FIG. 1B is a lateral side elevation view of the article of footwear shown in FIG. 1A.
Figure 1C:
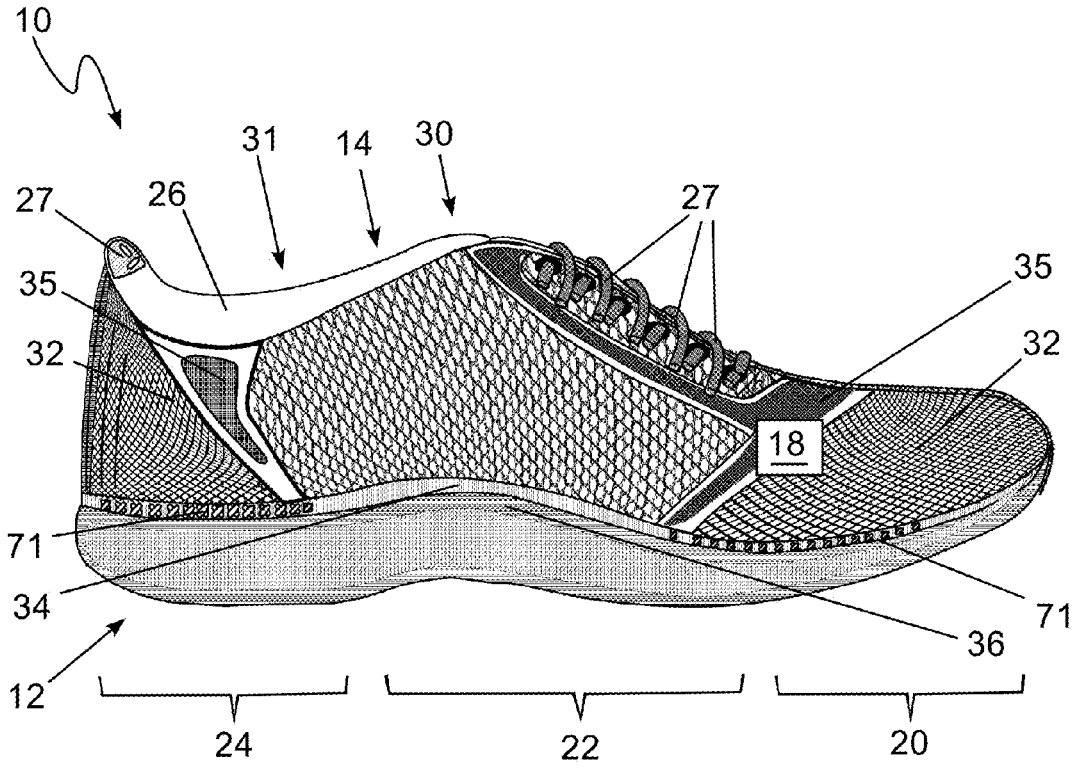
FIG. 1C is a medial side elevation cutaway view of the article of footwear shown in FIG. 1A.
Figure 2A:
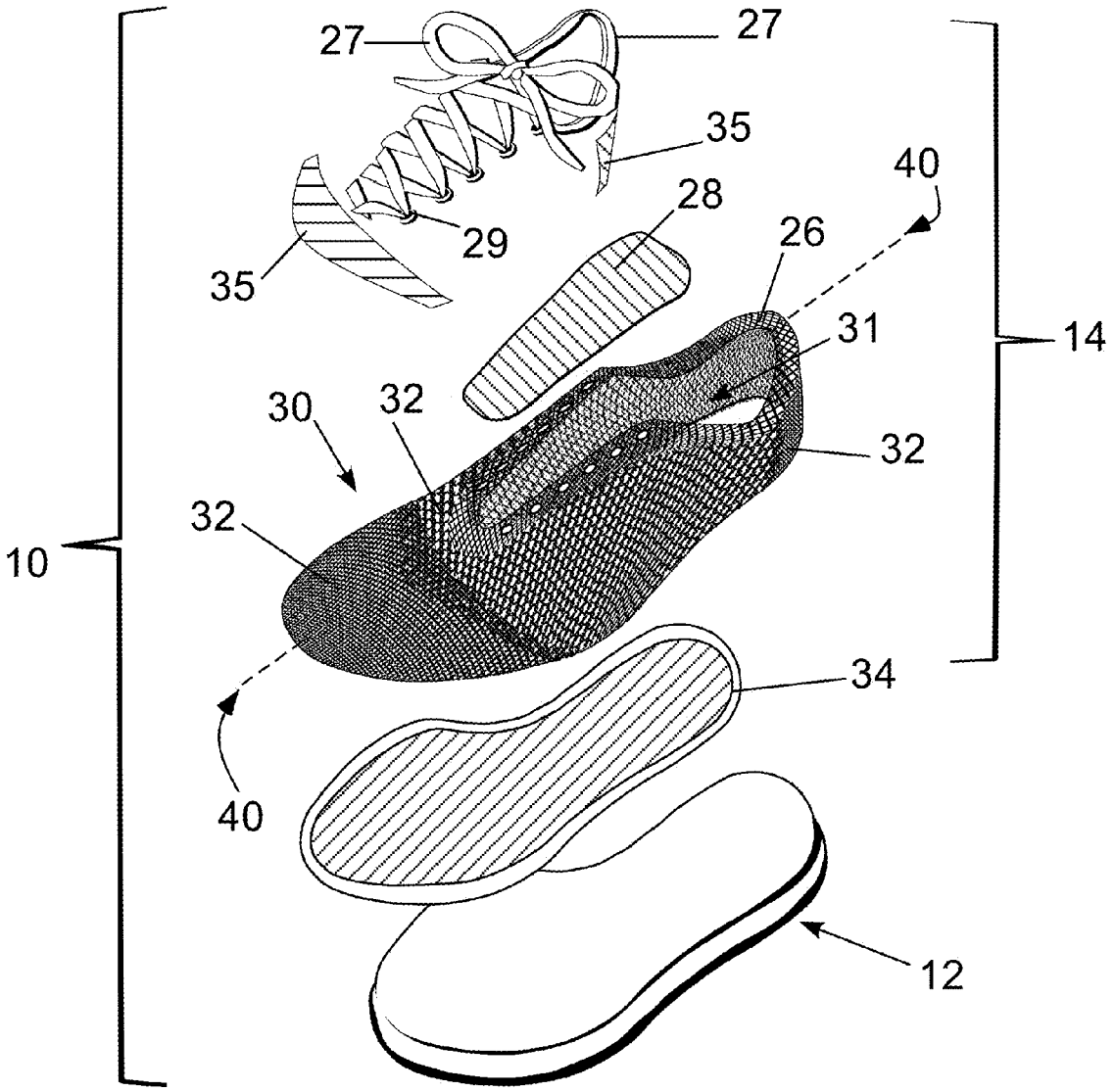
FIG. 2A is an exploded perspective view of an article of footwear.

FIG. 1A is a perspective view of an article of footwear 10 according to one aspect of the invention, for example, having one or more filament structures or patterns according to aspects of the invention. FIG. 1B is a lateral side elevation view of the article of footwear 10 shown in FIG. 1A, and FIG. 1C is a medial cutaway side elevation view of an article of footwear 10. FIG. 2A is an exploded perspective view of an article of footwear 10.

As shown in FIG. 1A, one aspect of the invention is an article of footwear 10. For the sake of facilitating the following discussion, article of footwear 10 may simply be referred to as "shoe 10," wherein it is to be understood that shoe 10 may comprise any article of footwear disclosed herein. For example, shoe 10 may comprise a running shoe, or any other type of athletic shoe, including, but not limited to, baseball shoes, basketball shoes, cross-training shoes, cycling shoes, football shoes, tennis shoes, soccer shoes, walking shoes, and hiking boots, among other athletic shoes. In addition, aspects of the invention may be used for non-athletic footwear, including, but not limited to, dress shoes (men's and women's), loafers, sandals, slippers, and work boots, and the like. Accordingly, it will be understood by those of skill in the art that aspects of the present invention are applicable to any form of footwear, and to the range of shapes, styles, and materials for footwear typically encountered in the art.

As shown most clearly in FIGS. 1A-1B, according to one aspect of the invention, upper 14 may comprise a plurality of individual components, for example, an ankle collar 26; a fit adjusting system, for example, shoe laces 27; structural supporting members 35 and a tongue 28. Though not shown, shoe 10 may also include a toe guard and a heel guard, among other structures typically found on and in conventional footwear. As also shown in FIGS. 1A-1B, shoe 10 according to aspects of the invention typically include an upper structure 14, and a substantial portion of the upper structure 30 which comprises one or more filament structures 32, for example, one or more of the filament structures illustrated in and disclosed with respect to FIGS. 11 through 19. An upper 30 may be defined as the portion of an upper 14, which is a unified patterned plexus of filaments 30. The upper 30 may comprise the entirety of upper 14, or just a substantial portion of upper 14. Upper 30 may be formed from a planer or "flat" plexus of filaments and formed into a "hollow", or consist of a substantially tubular plexus of filaments, which would create upper 14, or comprise upper 30. In one aspect, upper structure 30, and other upper structures disclosed herein, may be referred to as "skeletal" structures, for in some aspects of the invention upper structure 30 provides a skeletal support or framework for the upper 14, for example, a skeletal framework upon which the upper 14 can be shaped or constructed. In another aspect, supporting members 35 extend from the sole 12 of shoe 10. Supporting members offer structural support to the plexus of filaments and stiffen different portions of a plexus of filaments; where desired for comfort and restraint. The material of the supporting members 35 may be made from a rubber or another polymer, for example, a material that is durable and wear-resistant, for instance, an elastomeric material or a foam elastomeric material, and the like.

Figure 3A:
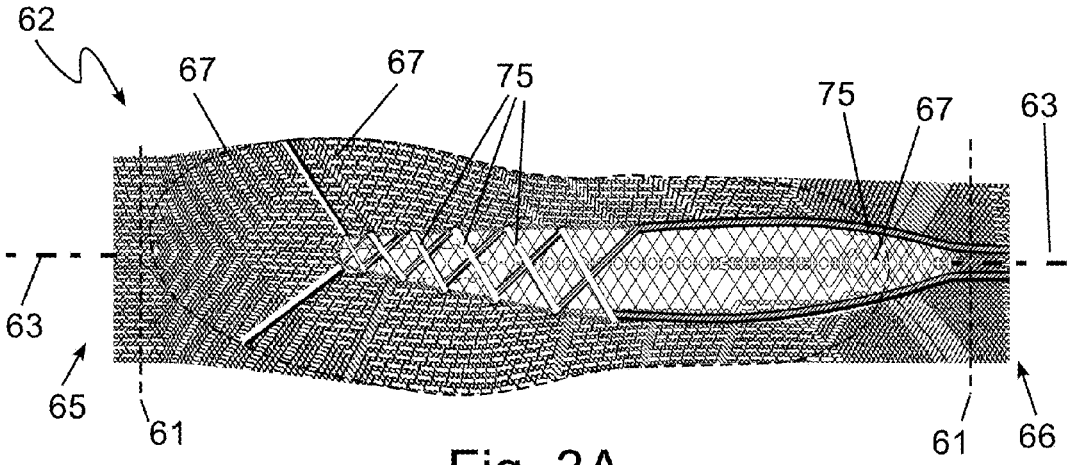
FIG. 3A is a schematic top plan view and FIG. 3B is a schematic bottom plan view of a preliminary upper structure fabricated with a programmable automated braiding machine, according to one aspect of the invention.

In another aspect, upper structure 30 has a void 31 within shoe 10 for receiving a foot (not shown). That is, void 31 may typically be positioned and shaped to accommodate a foot and may extend along the length of the foot and at least partially around the foot. In one aspect, upper structure 30 may comprise a "hollow" structure, for example, a structure defining an empty internal space, for example, the void 31. Though in one aspect, hollow upper structure 14 may comprise a structure substantially completely encircling the foot of the wearer, in other aspects of the invention, a hollow upper structure 30 may only partially encircle the foot of the wearer while still defining an empty internal space within the confines of hollow upper structure 30. For example, a hollow upper structure 30 may define an arc of the upper portion of which upper structure 30 is a part, and the space subtended by the arc of hollow structure 30 may define void 31, or an internal space shaped to encompass a foot. As is typical in the art, access to void 31 is provided by an ankle collar 26 positioned approximately in the heel section 24 of shoe 10. As also shown, shoelaces 27 may be provided and extend through lace apertures 29. According to one aspect of the invention, lace apertures 29 may be patterned into the upper structures 30, as will be discussed more fully below. In addition, in one aspect, as also shown in FIG. 3A, shoelace 27 may be formed integrally with plexus of filaments that is a part of the upper 30, as will be discussed more fully below.

With reference to FIGS. 1A-1B, as is typical of the existing art, shoe 10 may typically include a sole structure 12 and an upper portion 14 (or simply "an upper 14"). Shoe 10 also includes a lateral side 16—that is, a side facing away from the centerline of the wearer (not shown)—and a medial side 18—that is, a side facing toward the centerline of the wearer; a forefoot section 20 that generally includes portions of shoe 10 encasing the toes of the foot (not shown); a midfoot section 22 that typically includes the portions of shoe 10 corresponding with the arch area of the foot; and a heel section 24 that generally includes the rear most portions of the foot.

According to aspects of the invention, and as known in the art, upper 14 may typically be secured to sole portion 12.

Sole portion 12 typically extends between the upper and the ground or floor (not shown) when shoe 10 is secured to a foot and used. As known in the art, sole portion 12 typically protects the upper 14 and the foot from contact with the ground or floor and may provide traction and attenuate loading on the foot while walking, running, jumping, climbing, or other activities. According to aspects of the invention, the shape, construction, and material of sole portion 12 may vary broadly while providing the desired interface with the ground or floor. For example, sole portion 12 may made from a rubber or another polymer, for example, a material that is durable and wear-resistant, for instance, an elastomeric material or a foam elastomeric material, and the like.

FIG. 1C is a medial cut away side elevation of an article of footwear, wherein there is an upper portion 30 attached to a sole 12 which may be secured to the sole 12, a sole interface, or "innersole" 34. An innersole 34 may be used as an interface between the sole portion 12 and an upper portion 14 wherein the lower portion of a substantially tubular plexus of filaments 30, which has been integrally, molded 71, into the innersole 34 to provide a durable interface between sole 12 and a foot. Notably a portion of the lower part of an upper portion 30 may not be molded into the innersole; in particular, underneath the arch 36 of a foot, subsequently providing additional support and astriction to a user's foot when the laces 27 pull upon, or add tension to either side of an article of footwear, and when tension applied to the laces is transferred through the plexus of filaments around a user's foot. An upper portion 30 is comprised a plurality of patterned filaments which may be integrated into a singular plexus designed to securely and comfortably astrict a user's foot. Also shown in FIG. 1C are laces 27 which may be utilized to tension either side of a shoe 10 around a user's foot and typically, be tied together to secure a user's foot to a sole 12. FIG. 1C shows that the laces 27 may also extend from the upper front portion of the shoe 10 around and/or through a heel collar 26 and back to the forefront of the shoe where laces 27 are typically tied. Laces 27 which extend around a heel collar 26 and back to the upper eyelets where a shoe would typically be tied or fastened, can provide a method of tensioning portions of the shoe 10 which are not typically included in the tensioning system laces provide; such as the heel and ankle portions, thus more securely binding a user's foot to a sole 10. Supporting members 35 extend from the sole 12 of shoe 10. Supporting members offer structural support to the plexus of filaments and stiffen different portions of the plexus where desired for comfort and restraint.

In one aspect of the invention, as shown in FIGS. 1C and 2A, shoe laces 27 may be interlaced with various section of the upper 14, for example, interlaced with various upper structures 30. For example, as shown in FIGS. 1C & 2A laces 27 may extend about the heel or heel section 24 around, or through the ankle collar 26, and/or extend about the forefoot section 20 and/or the midfoot section 22. According to aspects of the invention, with the interlacing of lace 27 through various parts of shoe 10, the wearer of shoe 10 may tension various parts of shoe 10 about the user's foot, for example, to the sides as shown at 16 and 18, to the ankle collar as shown at 26, to the heel and/or heel section 24, for instance, by tensioning laces 27. Accordingly, the tensioning system created by laces, applied to a plexus of filaments, as described herein; is able to transfer tension energy throughout a plexus of filaments surrounding a foot, subsequently provide more comfort and support while minimizing chaffing. As will be illustrated more fully below, laces 27 and their interlacing of various parts of upper 30, may be provided with the fabrication of upper structure 30, that is; lace 27 may comprise a filaments braided into one or more filament arrangements of upper structure 30.

As shown in FIG. 2A, shoe 10 may also include an interface element or "inner-sole" 34 positioned between the upper structure 30 and the sole structure 12. According to one aspect of the invention, interface element 34 may be provided to assist in mounting the upper structure 30 to the sole structure 12. For example, in one aspect, one or more interface elements 34 may be integrally engaged with upper structure 30, for instance, molded to upper structure 30; and wherein the upper structure 30 and interface element 34 may be attached to sole portion 12, for example, by means of an adhesive, stitching, or one or more mechanical fasteners. In another aspect, one or more interface elements 34 may be positioned within upper structure 30 and then secured to sole structure 12, for example, by means of an adhesive, stitching, and/or one or more mechanical fasteners, thus substantially securing upper structure 30 to sole structure 12.

In one aspect of the invention, the interface element 34 or the engagement of the interface element 34 with the upper structure 30 may be provided at the primary pressure points of the bottom of a foot; for example, in the area of the heel, the forefoot, and/or the toes 40.

In one aspect, the integral molding of upper structure 30 with interface element 34 may be provided by compressing at least one or more portions of upper structure 30 into an uncured curable material, for example, into an uncured polymer and the like, and then curing the material whereby the material integrally and, for example, semi-rigidly, engages one or more filament structures 32 in upper structure 30. According to aspects of the invention, this integral molding of the interface element 34 with at least one portion of upper structure 30 provides a strong, integral bond between the upper structure 30 and the interface element 34. According to aspects of the invention, the interface element 34 may assume a broad range of shapes and sizes, including thicknesses, depending, among other things, upon use and/or appearance of the shoe being fabricated, for example, a dress shoe compared to an athletic shoe.

In one aspect, the interface element 34 may not engage a portion of the upper structure 14 in or about the arch region of the upper structure 14, for example, in or about the area of the midfoot section 22. In one aspect, the arch area of upper structure 14, for example, when not engaged with interface element 34, may be structurally engaged with and/or influenced by shoe laces 27 whereby the tensioning of shoelaces 27 also tensions at least a portion of the upper structure 14 at or about the arch of the foot. Among other things, the tensioning of the area beneath the arch of a foot can provide support, for example, adjustable support, to this typical critical area of contact or engagement between the sole structure 12 and upper 14.

Figure 2B:
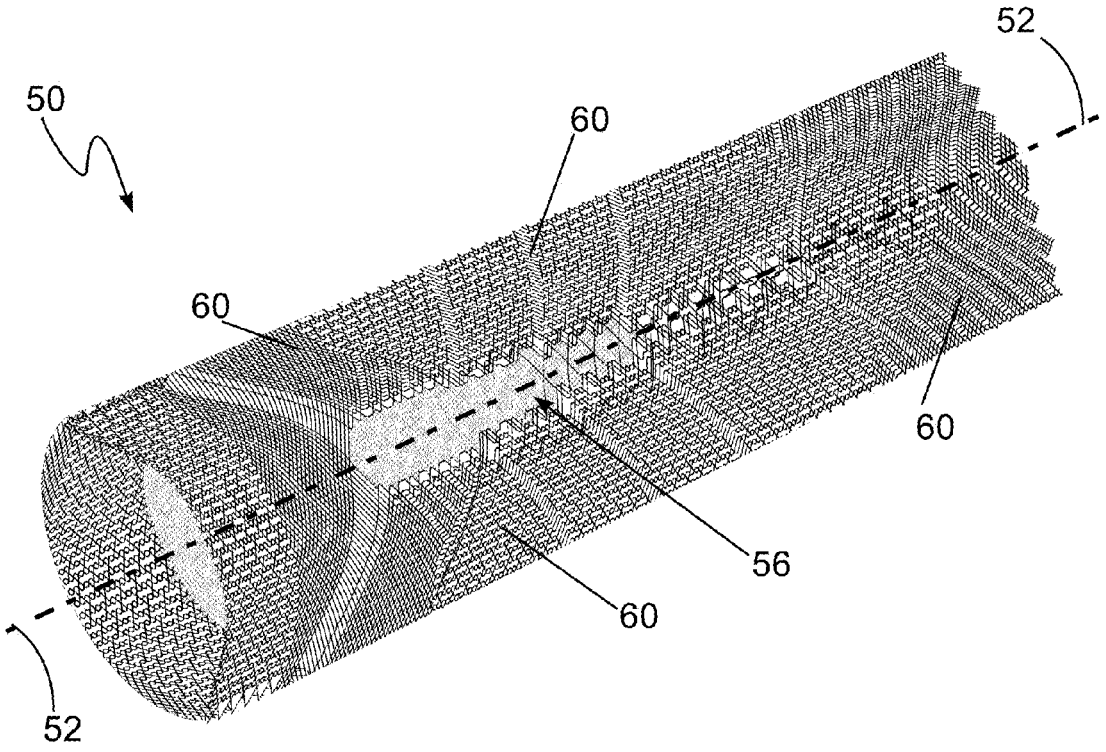
FIG. 2B is a perspective view of a substantially tubular plexus of patterned filaments, which would comprise a portion of an upper structure of an article of footwear.

FIG. 2B is a schematic perspective view of one cylindrical or tubular upper structure 50 that may be used for upper structure 14 shown in FIG. 1C. FIG. 2B is a schematic representation of the appearance of upper structure 50 as it may be fabricated by a programmable braiding machine. Similar to upper structure 14, upper structure 50 may typically comprise an elongated tubular structure having an elongated central axis 52 where upper structure 50 is elongated in the direction of elongated central axis 52.

As shown in FIG. 2B, upper structure 50 may be an elongated cylindrical or tubular structure and include at least one opening or aperture 56 designed to receive ankle collar 26 and/or tongue 28.

In FIG. 2B, for the sake of clarity of illustration, the opening 56 is shown shaded, and not open. For example, in an actual upper support 30, the opening 56 will typically expose the internal surface of the tubular plexus; however, such a depiction is believed to detract from the clarity shown by shading opening 56.

The cylindrical structure of upper structure 50 may be circular cylindrical, oval cylindrical, triangular cylindrical, rectangular cylindrical, or polygonal cylindrical, among other cylindrical shapes. As also shown in FIG. 2B, upper structure 50 may comprise one or more filament arrangements 60, for example, one or more of the filament structures illustrated and described with respect to FIGS. 11 through 19. In one aspect, the one or more filament arrangements 60 may be formed in upper structure 50 during the automated, programmable braiding process. For example, multiple filament arrangements 60 of varying filament engagement, linkages, and interlacings may be provided in upper structure 50 while structure 50 is being formed by an automated braiding machine.

According to aspects of the invention, upper structures 30 or 50 may be fabricated by any conventional means to provide at least some of the benefits of the disclosed invention. For example, upper structures 30 or 50 may be fabricated by hand, for example, by manual weaving or braiding; by a machine or apparatus, for example, a weaving device, a loom, or a braiding device. In one aspect, aspects of the present invention may be fabricated by an automated device, for example, an automated weaving device, an automated loom, or an automated braiding device. These machines may be programmable machines that are adapted to receive and executed a series of commands based upon instructions, for example, instructions provided in a database or even punch cards or perforated cylinders.

Figure 2C:
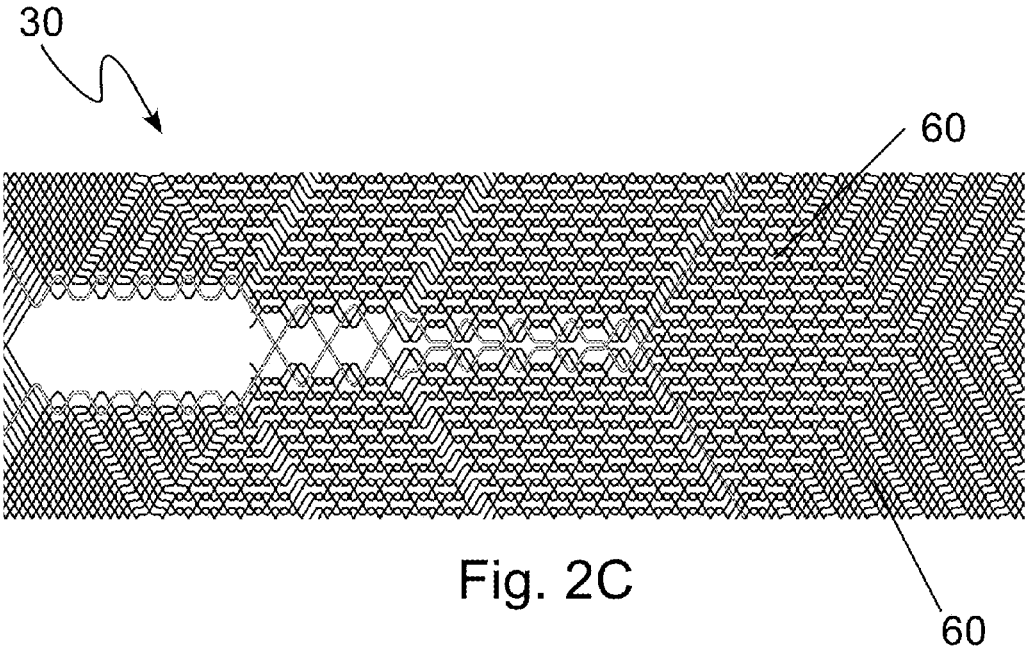
FIG. 2C is a plan view of the appearance of a plexus of patterned filaments which would comprise a portion of an upper structure of an article of footwear.
Figure 2D:
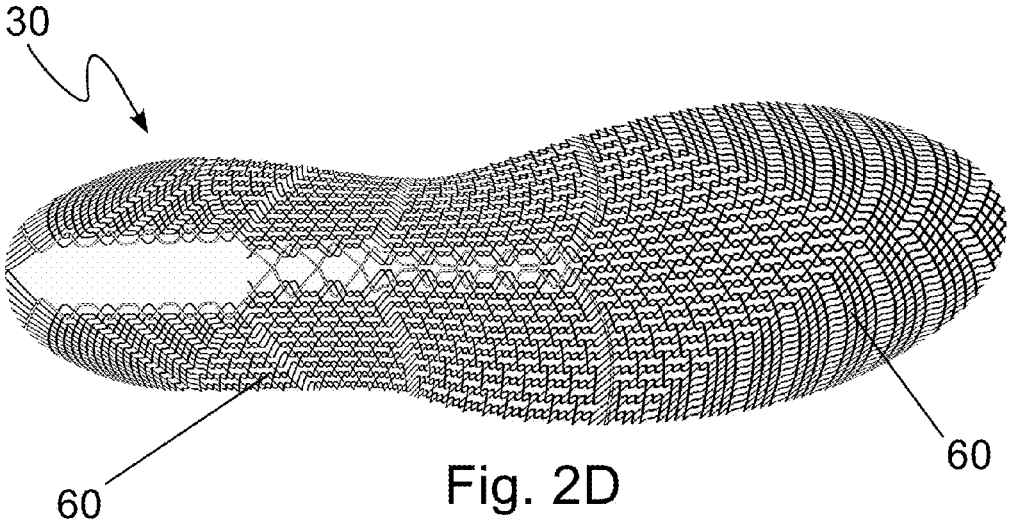
FIG. 2D is a plan view of the appearance of a plexus of filaments, which has been shaped to form an upper structure of an article of footwear.

FIGS. 2C & 2D show; in one aspect, the upper structures 30 may be fabricated as planar structures, for example, two dimensional weaves or braids as shown in FIG. 2C, and then formed into a hollow structure as shown in FIGS. 2A & 2D. For example, a planar structure having one or more filament arrangements 60 may first be formed, and then the planar structure formed into a hollow and/or cylindrical structure, for example, by being positioned on or over a cylindrical mandrel, and then connecting opposing sides of the planar structure, for example, with one or more stitches, an adhesive, and/or mechanical fasteners. Other means of forming a hollow or partially cylindrical shape from a planar structure will be apparent to those of skill in the art.

Figure 3B:
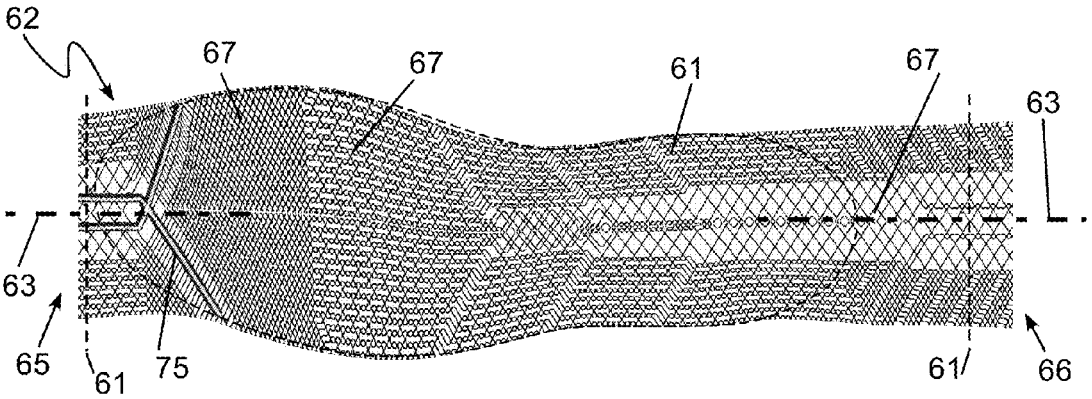

FIG. 3A is a schematic top plan view and FIG. 3B is a schematic bottom plan view of a preliminary upper structure 62 that may be fabricated with a programmable automated braiding machine, which may be used to create a skeletal structure which at least partially defines an article of footwear. Structure 62 is referred to as a "preliminary upper structure" herein since structure 62 typically may be modified before being secured to a sole 12 to create shoe 10 or other piece of apparel or accessory.

Upper structure 62 shown in FIGS. 3A and 3B also illustrates the expandability of the filament structures that comprise upper structure 62 and other aspects of the invention. For example, upper structure 62 shown in FIGS. 3A and 3B may be formed by expanding the tubular upper structure 50 shown in FIG. 2B about a shoe shaped mandrel or last in order to provide the desired shoe shape. However, it will be apparent to those of skill in the art, that aspects of the invention may be expanded (or compressed) about any shaped object or form. In addition, FIGS. 3A and 3B further illustrate the conformability of the filament structures provided by aspects of the invention, where aspects of the invention may not only expand about a desired object or shape.

Preliminary upper structure or foot encompassing plexus of filaments 62 as shown in FIGS. 3A & 3B comprises an elongated cylindrical tubular structure having an elongated central axis 63 where upper structure 62 is elongated in the direction of elongated central axis 63. As shown in FIGS. 3A and 3B, upper structure plexus of filaments 62 may include at least one opening or aperture 64 patterned into the plexus of filaments to receive an ankle collar and/or tongue, and having presently an open end 65 corresponding to or positioned at the forefoot section or toe of shoe 10, and a presently open end 66 corresponding to or positioned at the heel section of shoe 10. Upper structure 62 may also include one or more shoe laces 75, for example, laces 75 interlaced with upper structure 62, as discussed earlier and possibly provided with the braiding of upper structure 62.

As shown in FIGS. 3A and 3B, preliminary upper structure 62 includes one or more filament arrangements 67, for example, one or more of the filament structures illustrated and described with respect to FIGS. 11 through 19. In one aspect, the one or more filament arrangements 67 and the laces 75 may be formed in preliminary upper structure 62 during the automated braiding process. For example, multiple filament arrangements 67 with varying filament engagement, linkages, and interlacings may be provided in preliminary upper structure 62 while structure 62 is being formed by an automated braiding machine. As also shown in FIGS. 3A and 3B, preliminary upper structure 62 may also include one or more shoelaces 75 and a plurality of shoelace apertures 69 which are patterned into the plexus to produce a hole where shoelaces could be introduced to replace existing filaments which also have been patterned into the plexus, thus being able expedite the manufacturing process of adding laces to footwear. FIGS. 3A & 3B show how a primarily tubular plexus of filaments could be manufactured from a continuous length of a patterned plexus of filaments, to which a machine has been programmed to run. The continuous tubular plexus would be cut along lines 61 as shown, with the open heel end 66 being then formed into the heel, and heel collar portions of a shoe, and the toe end 65 being formed to create the toe portion of footwear. FIG. 3B shows the underside of a patterned plexus of filament which shows the paths where laces would be patterned into the plexus, thus being able to serve as laces or replaced by shoelaces, during the manufacturing process.

Figure 4A:
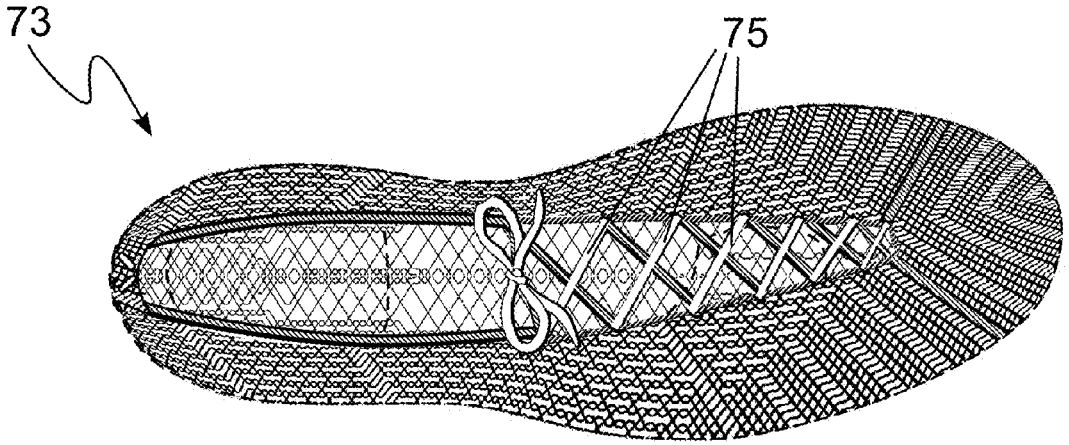
FIG. 4A is a schematic top plan view and FIG. 4B is a schematic bottom plan view of an upper structure fabricated from the preliminary upper structure shown in FIGS. 3A and 3B.
Figure 4B:
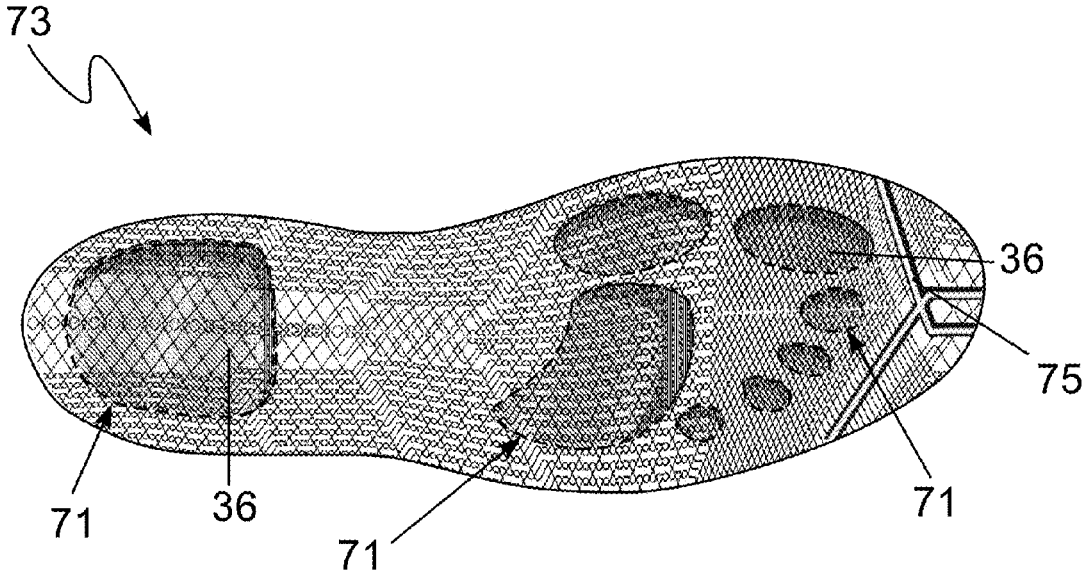

FIG. 4A is a schematic top plan view and FIG. 4B is a schematic bottom plan view of an upper structure or foot encompassing plexus of filaments 73 fabricated from preliminary upper structure 62 shown in FIGS. 3A and 3B. As shown in FIGS. 4A and 4B, the preliminary upper structure 62 shown in FIGS. 3A and 3B has been modified to conform to the shape of the desired shoe, for example, shoe 10 shown in FIGS. 1A & 1B. Specifically, in one aspect, preliminary upper structure 62 shown in FIGS. 3A and 3B has been trimmed, folded, glued, stitched, or otherwise modified to produce the upper structure 73. As shown, upper structure filament plexus 73 may include shoe laces 75 and/or one or more interface elements 71. FIG. 4B shows the points where upper structure 73 is integrally molded 36 into an interface as shown in FIG. 1C, at the primary pressure points of a foot. The interface element 71 could function as an innersole between the upper and the sole of an article of footwear, or said interface could function as a sole 12 portion of a shoe 10.

Figure 5:
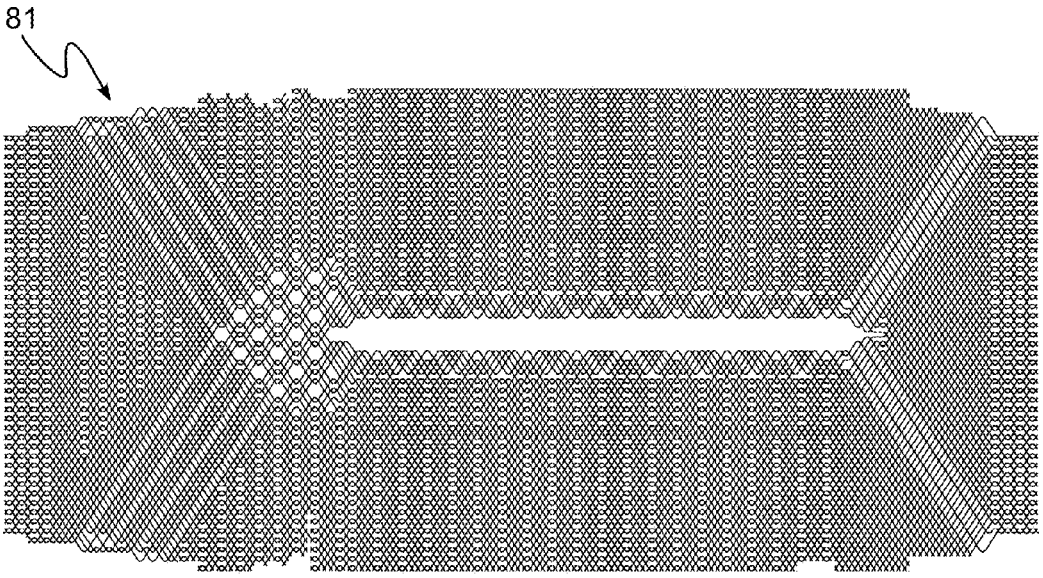
FIGS. 5 and 6 are plan views, similar to FIG. 2C, of a plexus of filaments which can be formed into an upper structure shown in FIGS. 2B & 2D, according to aspects of the invention.
Figure 6:
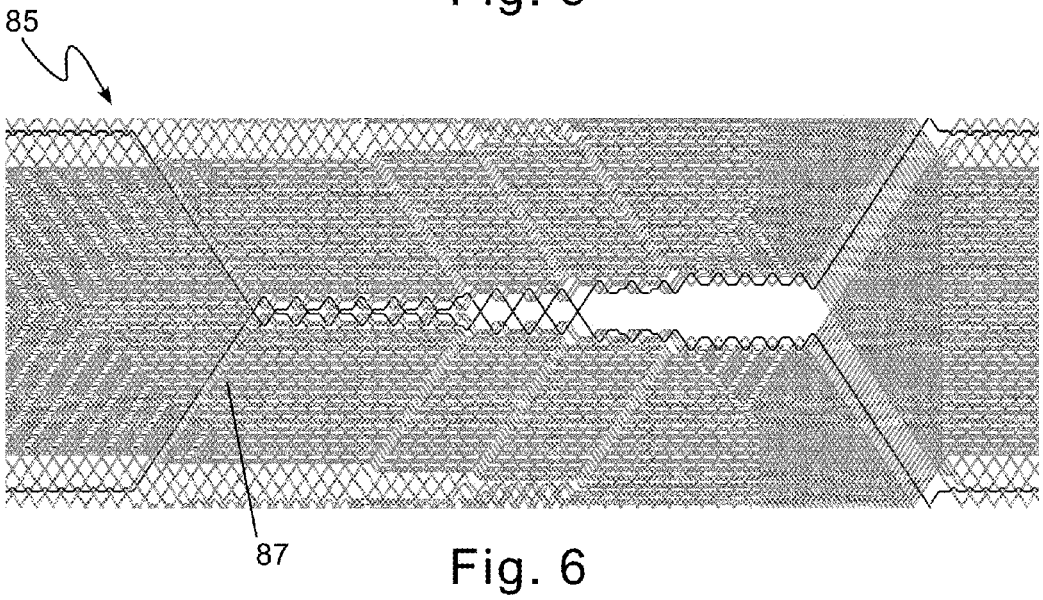

FIGS. 5 and 6 are plan views, similar to FIG. 2C, that may be used as the basis or skeletal framework of upper structure 14 shown in FIGS. 1A & 1B, according to aspects of the invention. Among other things, upper structure 85 shown in FIG. 6 includes a shoe lace 87, which may be provided during the braiding process when upper structure 85 is fabricated.

Figure 7:
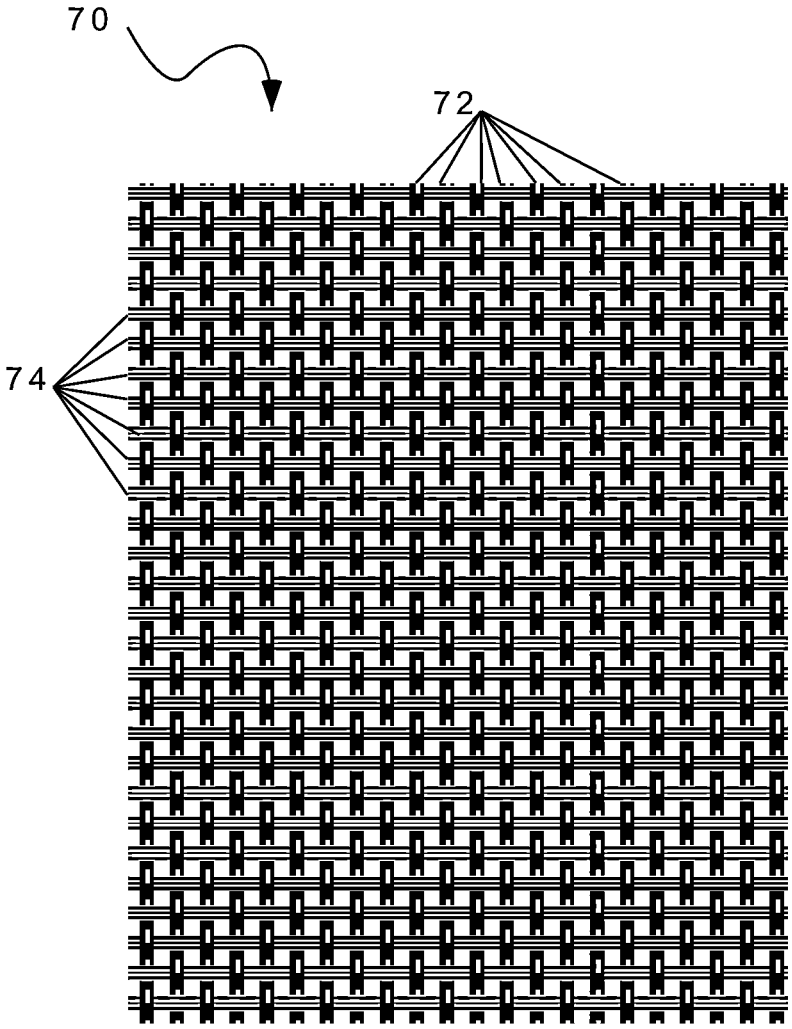
Fig. 7 Prior Art
FIG. 7 is a schematic illustration of a weave according to the prior art.

FIG. 7 is a magnified schematic illustration of a weave pattern 70 according to the prior art. As shown in FIG. 7, and as typical of filament patterns produced in weaving, weave pattern 70 typically includes a series or plurality of longitudinal or vertical "warp" filaments 72 which perpendicularly engage with a plurality of lateral or horizontal "weft" filaments 74. As shown, warp filaments 72 "interlace" with weft filaments 74, for example, pass over or under, a plurality of regularly spaced perpendicular filaments. As know in the art, the interaction of the warp filaments 72 and weft filaments 74, for example, through friction between the filaments, provides the structural integrity of the weave pattern 70.

Figure 8:
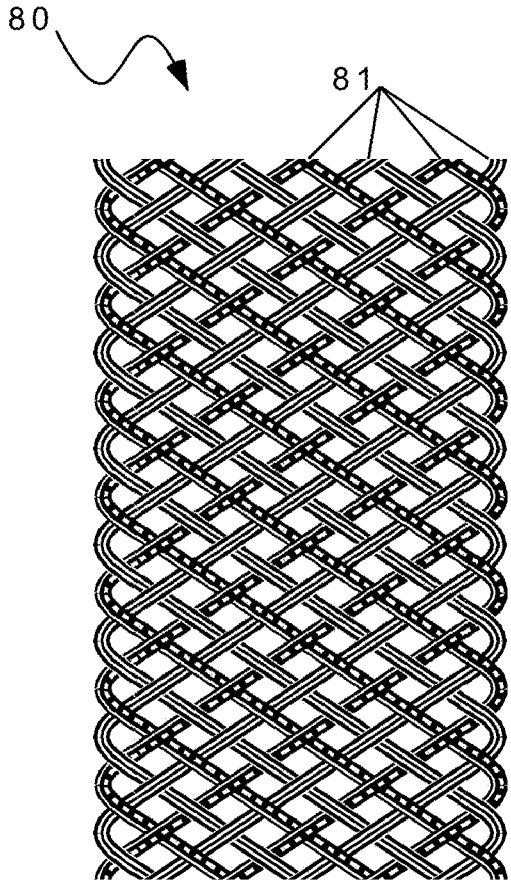
Fig. 8 Prior Art
FIG. 8 is a schematic illustration of a braid pattern according to the prior art.

FIG. 8 is a schematic illustration of a braid pattern 80 according to the prior art. As shown in FIG. 8, and as typical of filament patterns produced in braiding, braid pattern 80 typically includes a series or plurality of three or more filaments 81, which are "interlaced" to typically form an elongated, filament pattern 80. In distinction from the weave pattern 70 shown in FIG. 7, in braid pattern 80, the filaments 81 typically "interlace" with each other repeatedly at regularly spaced intervals, along the 45 degree axis. As known in the art, the engagement of the filaments 81, through friction created from the contact between the filaments, provides the structural integrity of the braid pattern 80.

Figure 9:
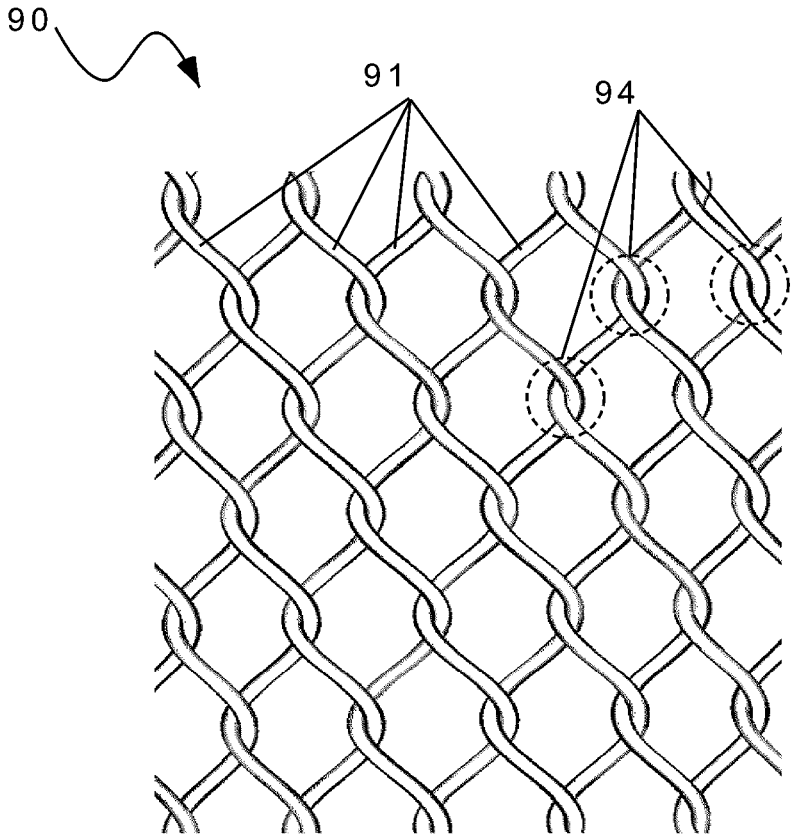
Fig. 9 Prior Art
FIG. 9 is a plan view of a portion of a typical chain-link fence having "linked" members according to the prior art.

FIG. 9 is a plan view of a portion 90 of a typical chain-link fence having "linked" members or wires 91 according to the prior art. As shown in FIG. 9A, linked 94 fence portion 90 typically includes a series or plurality of three or more wires 91, generally directed vertically, that engage adjacent wires 91 by partially wrapping 94, or linking 94 the wires 91 around neighboring wires, repetitively at regularly-spaced intervals. As know in the art, the engagement of the wires 91 at the "links" 94, provides the structural integrity of the wire fence portion 90.

Figure 10:
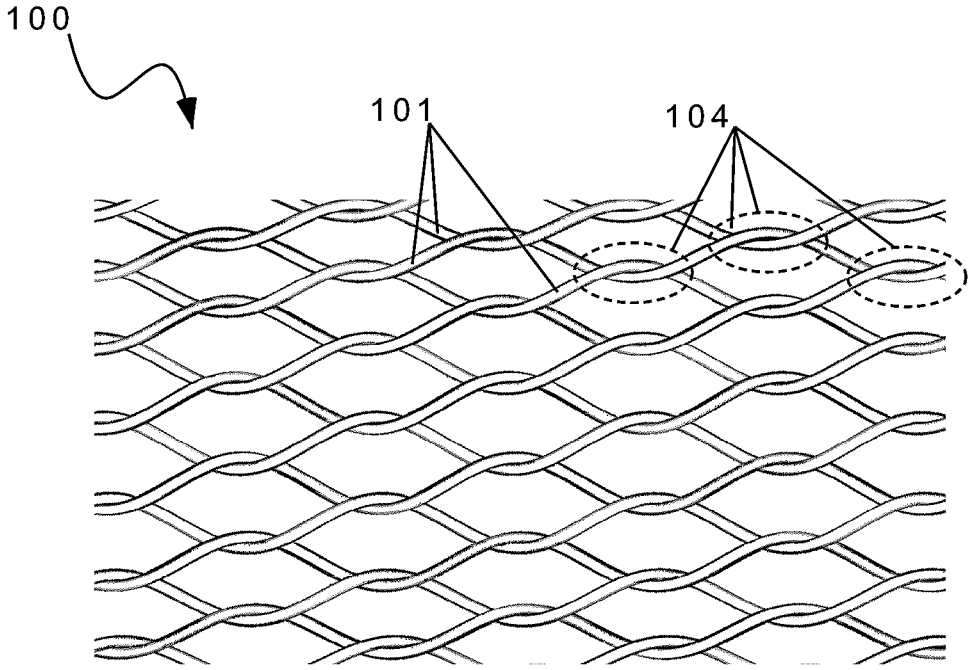
Fig. 10 Prior Art
FIG. 10 is a plan view of a portion of a typical hammock having "linked" members according to the prior art.

FIG. 10 is a plan view of a portion 100 of a typical hammock having "linked" members 104 according to the prior art. As shown in FIG. 10, hammock portion 100 typically includes a series or plurality of two or more ropes 101 directed generally in the same direction, for example, substantially in a horizontal direction in FIG. 10 and, that engage adjacent ropes 101 by partially wrapping or linking neighboring ropes 101 repetitively at regularly-spaced intervals. As known in the art, the interaction of the ropes 101 at the links 104, provide the unification of the ropes into one plexus of filaments, through friction, and the opposed tension created by the repetitive linking of the adjacent ropes along the length of the ropes, thus providing the structural integrity of the hammock portion 100.

According to an aspect of the invention, strands or filaments engage other filaments with one or more links similar to links 94 in FIG. 9 and links 104 in FIG. 10 to provide integral filament structures having enhanced flexibility and durability compared to prior art filament structures. In some aspects, the linking of filaments is accompanied by interlacing of filaments.

According to aspects of the invention, a "filament" may comprise any number of filaments or be composed of a variety of material, for example, a stretch yarn such as Spandex may be surrounded by nylon filaments creating a hybrid strand or yarn. A strand may be a fiber, a thread, a yarn, a string, a wire, or a cable, among other slender structures. A "filament" as disclosed herein may be composed of any number of individual filaments or different materials that can be could be combined or joined into a "filament", which may comprise a plurality of individual filaments. For example, plexus of filaments as disclosed herein may be metallic, for instance, iron, steel, stainless steel, aluminum, titanium, nickel, magnesium, brass, bronze, copper, silver, gold, or any other structural or ornamental metal; or non-metallic, for instance, a natural fiber, such as cotton, hemp, or jute; carbon fibers; a plastic or polymer, for instance, a polyamide (PA), for example, nylon; a polyethylene (PE); a polypropylene (PP); a polyester (PE); a polytetraflouroethylene (PTFE); an acrylonitrile butadiene styrene (ABS); a polycarbonate (PC); a polyvinylchloride (PVC); or an aromatic polyamide (that is, aramids), among other plastics; or an elastomeric material, for instance, a natural polymer, such as, polyisoprene rubber, or a synthetic polymer, such as, a neoprene, a thermoplastic elastomer, a thermoplastic rubber, a polyvinyl chloride, or an ethylene propylene diene monomer (EPDM) rubber, and the like.

Figure 11:
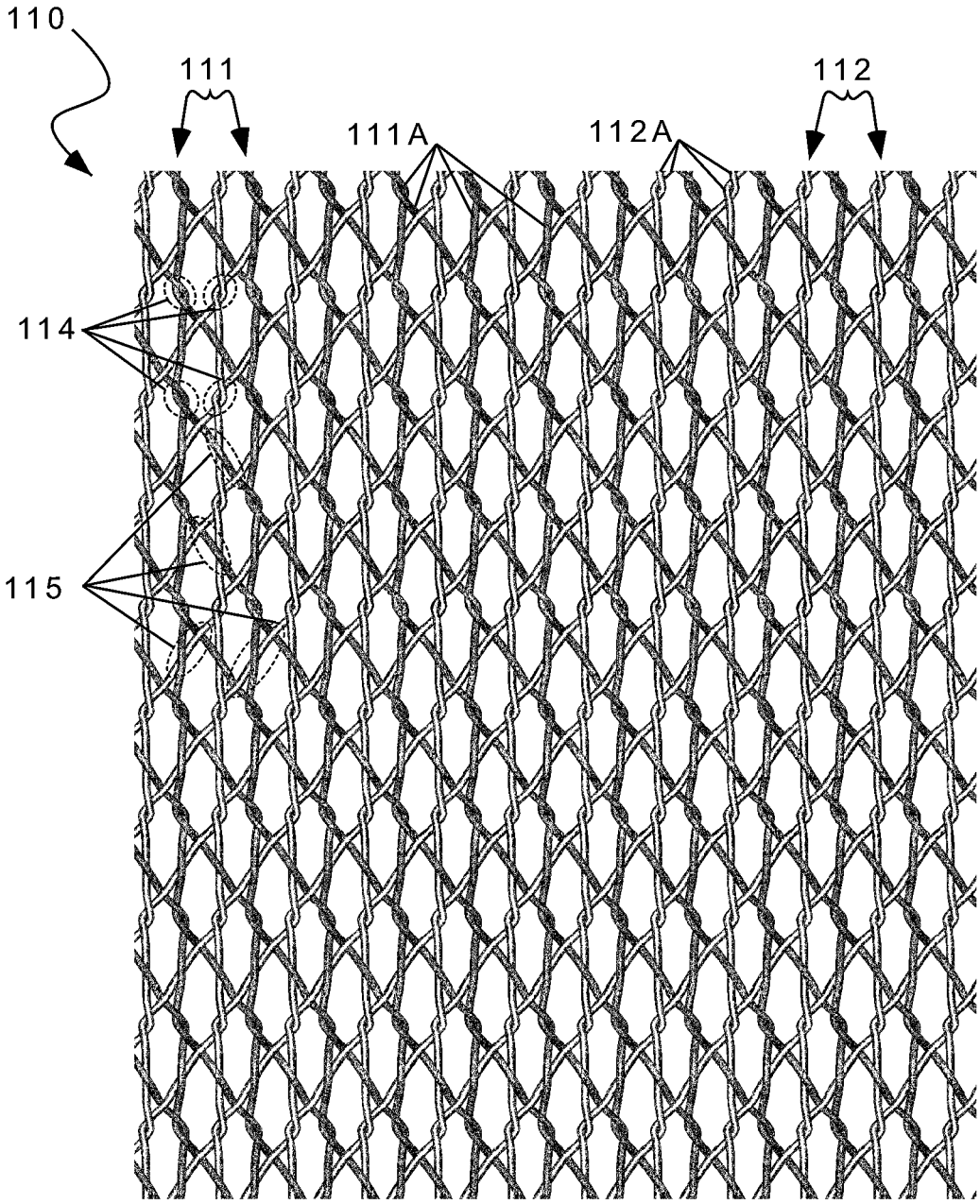
FIG. 11 is a plan view of a patterned plexus of filaments which has two groups of linked filaments which interlace, according to one aspect of the present invention.

FIG. 11 is a plan view of a plexus of strands 110 having "linked" and "interlaced" filaments according to one aspect of the present invention. As shown in FIG. 11, arrangement 110 typically includes a first plurality or group of filaments 111, which is, comprised of at least two filaments, which are directed adjacent to the other filaments within the group of filaments 111, and a second plurality or group of filaments 112, that is, typically, at least two filaments which are directed adjacent to one another and cross paths or bisect the other group of filaments. FIG. 11 shows that, filaments 111A in the plurality of adjacent filaments 111 are linked to neighboring filaments with the plurality or group of filaments 111. Also depicted in FIG. 11 are filaments 112A which lie adjacent to the other filaments 112A in the group 112, and are linked 114 to neighboring filaments in the same group of filaments. The linking of neighboring adjacent filaments 114 within a group of filaments can be defined as, filaments which pass over a neighboring filament and changing direction subsequently pass under the same filament, it is to be understood that this is a reciprocal relationship whereby if one strand passes over and under another strand creating a link the other strand must pass under and over the other strand to form an individual link 114.

FIG. 11 also shows that filaments 111A from the first plurality of filaments 111 are interlaced 115 with filaments 112A which belong the second plurality or group of filaments 112. The relationship between interlaced filaments 111A and 112A can be defined as filaments that pass over and subsequently under bisecting filaments, or under and over bisecting filaments. The interlaced filaments 115 unify the two groups 111 & 112 of adjacent filaments into one plexus of filaments 110, and typically bear against each other, for example, contact each other where they cross paths. It will be understood by those skilled in the art that interlacements 115 of filaments 111A & 112A have a reciprocal interlacing relationship, that is to say for example, if the group of filaments 111 are interlaced with the group of filaments 112, it could also be said that the group of filaments 112 are interlaced with the group of filaments 111.

The inventor has found that such a construction provides enhanced flexibility and durability, for example, providing enhanced expansion and constriction capabilities, especially in comparison to prior art woven and braided constructions. For instance, when this filament structure is incorporated into furniture, for example, a chair or a lounge chair or sporting goods for example, a hockey stick or golf club, or sports apparel such as, running shoes or protective gear.

Figure 12:
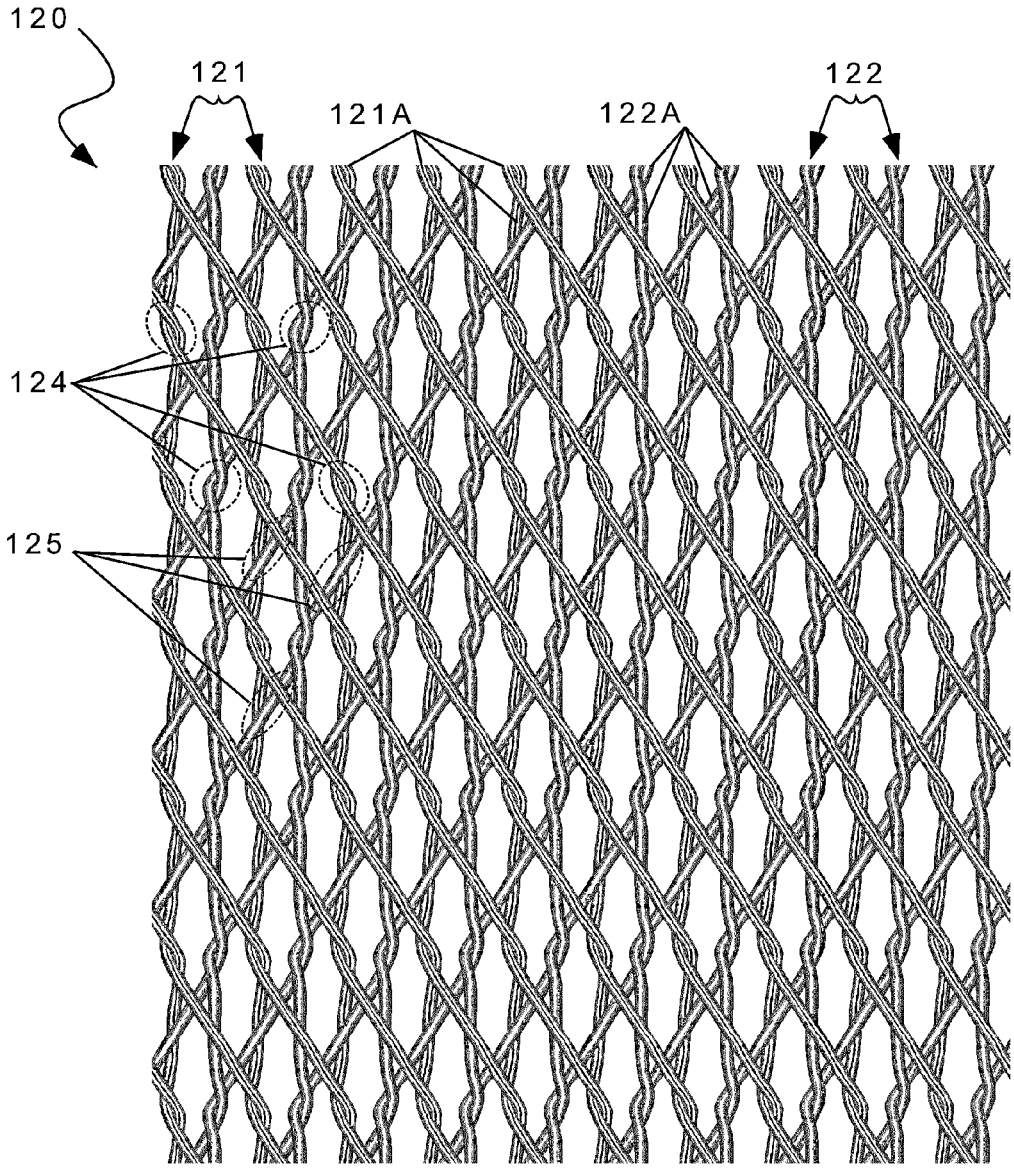
FIG. 12 is a plan view of a patterned plexus of filaments which has two groups of linked filaments which interlace, according to one aspect of the present invention.

FIG. 12 is a plan view of another plexus of strands 120 having "linked" and "interlaced" filaments according to another configuration of the present invention. As shown in FIG. 12 plexus 120 typically includes a first plurality or group 121 of filaments 121A, wherein the filaments which make up the group lie adjacent to the other filaments within the group 121 of filaments 121A within the plexus of strands 120, and are linked 124 to the other filaments 121A within the group 121 of filaments. FIG. 12 also shows a second plurality or group 122 of filaments 122A, which lie adjacent to the filaments within the group 122 of filaments 122A, and wherein the filaments 122A are linked 124 to neighboring filaments within the group 122. FIG. 12 also show that the two filaments groups 121 & 122 are interlaced 125 with filaments 121A & 122A passing over and under or under and over bisecting filaments. It should be noted that while FIG. 11 & FIG. 12 both show two adjacent groups of filaments bisecting each other, and having filaments which cross paths the same amount of times between linked filaments; the plexus of strands are interlaced less in FIG. 12 than in FIG. 11, this "lightly interlaced" aspect shown in FIG. 12 produces a plexus where the filaments are not bent as often, due to fewer interlacement of the filaments and subsequent bending of the filaments associated with interlaced filaments, therefore the alternative patterning shown in FIG. 12 is expected to produce a stronger plexus when used in composite structures than the pattern shown in FIG. 11. Alternatively the extra interlacements of filaments shown in FIG. 11 provides for more stability (non-displacement of filaments) within the plexus, which makes the pattern in FIG. 11 better suited to "dry" (non composite) usages such as clothing, sports apparel & footwear. It should be noted that the two opposed groups of adjacent filaments can be interlaced more or less times between the linking of the filaments within their own group, providing different characteristics within the plexus of filaments, without changing the basic construct of the present invention.

The plexus 120 of filaments shown in FIG. 12 represented one feature of aspects of the invention that characterize this and other aspects of the invention, that is, the minimization or elimination of sharp bends in filament paths that can damage or weaken filament structures, as in the prior art. For example, in prior art filament structures, such as, woven structures as illustrated in FIG. 7 or a braided structure as illustrated in FIG. 8, the paths of filaments typically repeatedly cross and re-cross each other in close proximity from one side of the filaments to the other side of the filaments, resulting in repeated bending of the filaments where they are forced to bend around opposed filaments. As recognized by the present inventor, this repeated bending, including sometimes severe and sharp bending of the path of the filaments, can damage or weaken one or more filaments, and weaken the overall structural integrity of a plexus of strands particularly when used within composite materials. As illustrated in, for example, FIG. 12, this undesirable sharp or severe bending can be minimized or eliminated, and, accordingly, a stronger, more durable filament arrangement can be produced. Specifically, as shown in FIG. 12, the linking and interlacing of filaments 121A and 122A, reduces or minimizes the frequency of undesirable sharp or severe bending. This reduction or minimization of the frequency of undesirable sharp or severe bending may also characterize other aspects of the invention disclosed herein.

Figure 13:
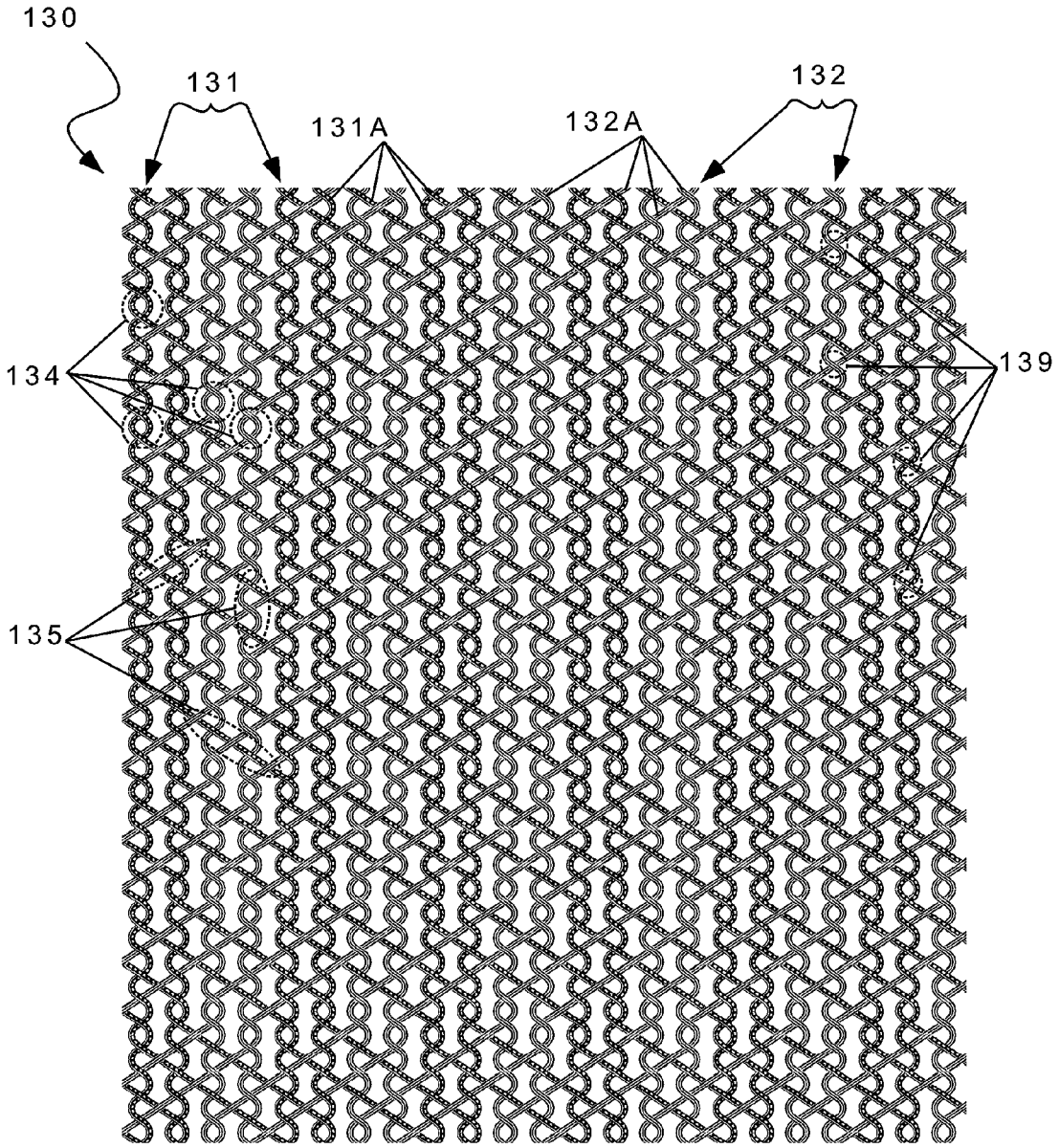
FIG. 13 is a plan view of a patterned plexus of filaments which has two groups of linked filaments which interlace, according to one aspect of the present invention.

FIG. 13 is a plan view of another plexus of filaments 130 having "linked" and "interlaced" filaments according to another configuration of the present invention. As shown in FIG. 13 plexus 130 typically includes a first plurality or group 131 of filaments 131A, wherein the filaments which make up the group lie adjacent to the other filaments within the group 131 of filaments 131A within the plexus of filaments 130, and are linked 134 to the other filaments 131A within the group 131 of filaments. FIG. 13 also shows a second plurality or group 132 of filaments 132A, which lie adjacent to the filaments within the group 132 of filaments 132A, and wherein the filaments 132A are linked 134 to neighboring filaments within the group 132. FIG. 13 also shows that the filaments within the group of filaments 131 and 132 are interlaced 135 a plurality of times in between where they are linked to the neighboring filaments within their own group of filaments. FIG. 13 also shows that the groups of filaments may also bisect 139 filaments within their own group of filaments, and still retain the same basic construct of opposed interlaced groups of linked filaments. FIG. 13 is another representation of the present invention where the exact patterning of the two linked groups of opposed interlaced filaments create a different aesthetic quality to the plexus without altering the fundamental properties which the present invention describes; such as, expansion, constriction and conformability as well as a displacement of tension upon the filaments within the plexus.

Figure 14:
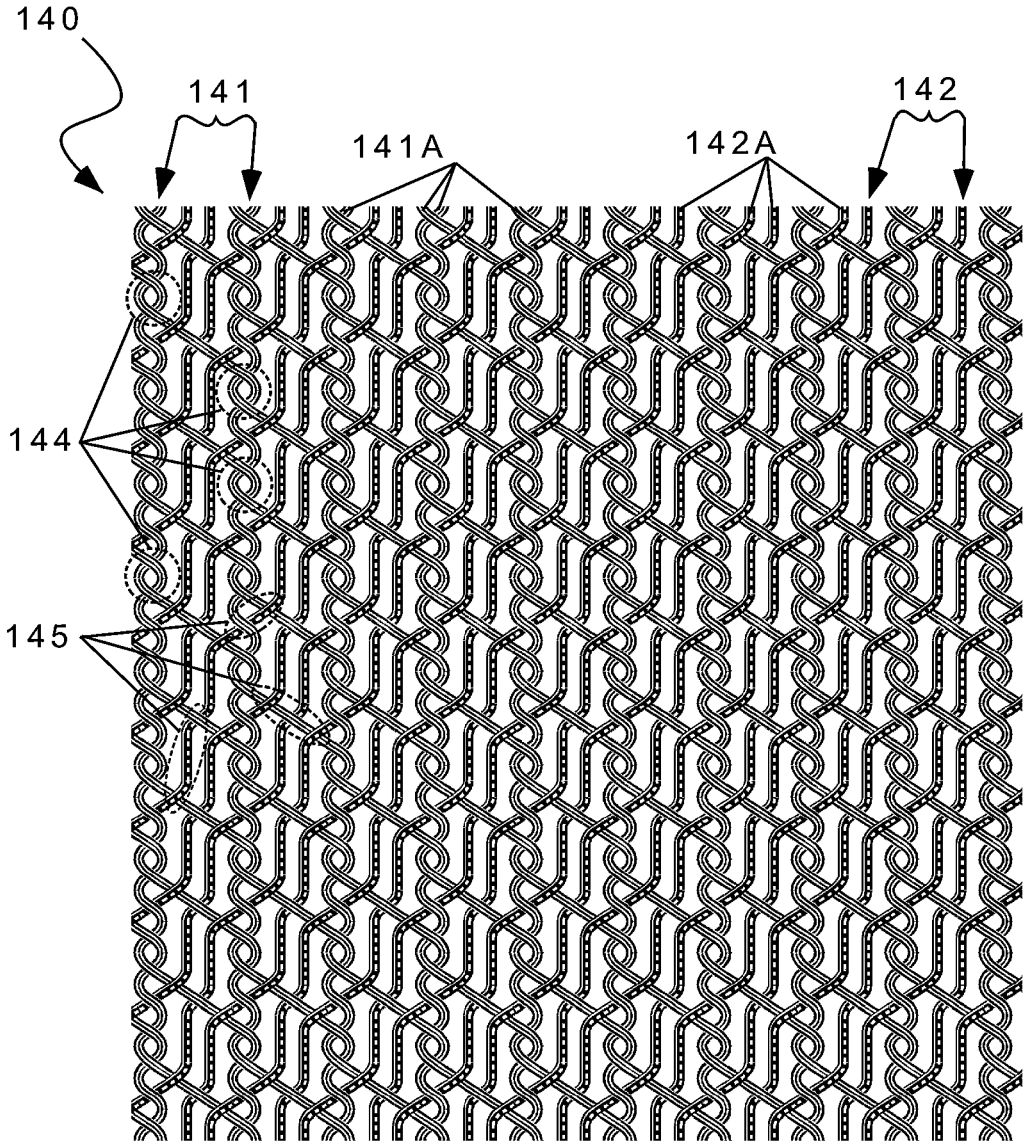
FIG. 14 is a plan view of a plexus of filaments which has a group of linked filaments which interlace with another filament group, according to one aspect of the present invention.

FIG. 14 is a plan view of another arrangement of filaments 140 having "linked" and "interlaced" filaments according to another facet of the present invention. As shown in FIG. 14, plexus 140 includes a first plurality, or group 141 of filaments 141A, which lie adjacent to the other filaments within the group 141 of filaments 141A within the plexus of filaments 140 and are linked 144 to neighboring filaments 141A within the group 141, also shown is a second plurality or group 142 of filaments 142A, which is also comprised of a plurality of filaments 142A, which lie adjacent to the other filaments within the group but are not linked to each other along their lengths but interlaced 145 to the opposed group of filaments. The example of a patterned plexus as shown in FIG. 14 reveals a versatility within the patterning of a plexus of strands while retaining the desired characteristics of a conformable plexus, amongst others, while retaining or improving upon strength, fiber cohesion or tension values, dependent upon the desired application. FIG. 14 also depicts a plexus where the different patterning within the opposed adjacent groups 141 & 142 of strands would provide different torsion or tensions to exist within the plexus particularly a tubular plexus, thus providing specific attributes, for specific applications.

Also revealed in the present invention shown in FIG. 14 is another facet of a family of patterns to which a variety of variations in the number of filaments, filaments within a group, group of filaments, or the number of times filaments link or interlace each other, may vary widely dependent upon the type of machine, thickness of strands and end function or aesthetic value to which the plexus has been designed for. The density of a plexus would also be highly variable dependent upon filament sizes, amongst others, as well as the speed to which pattern is produced by a machine in relation to how fast filaments are delivered, or pulled from spools by a machine.

Figure 15:
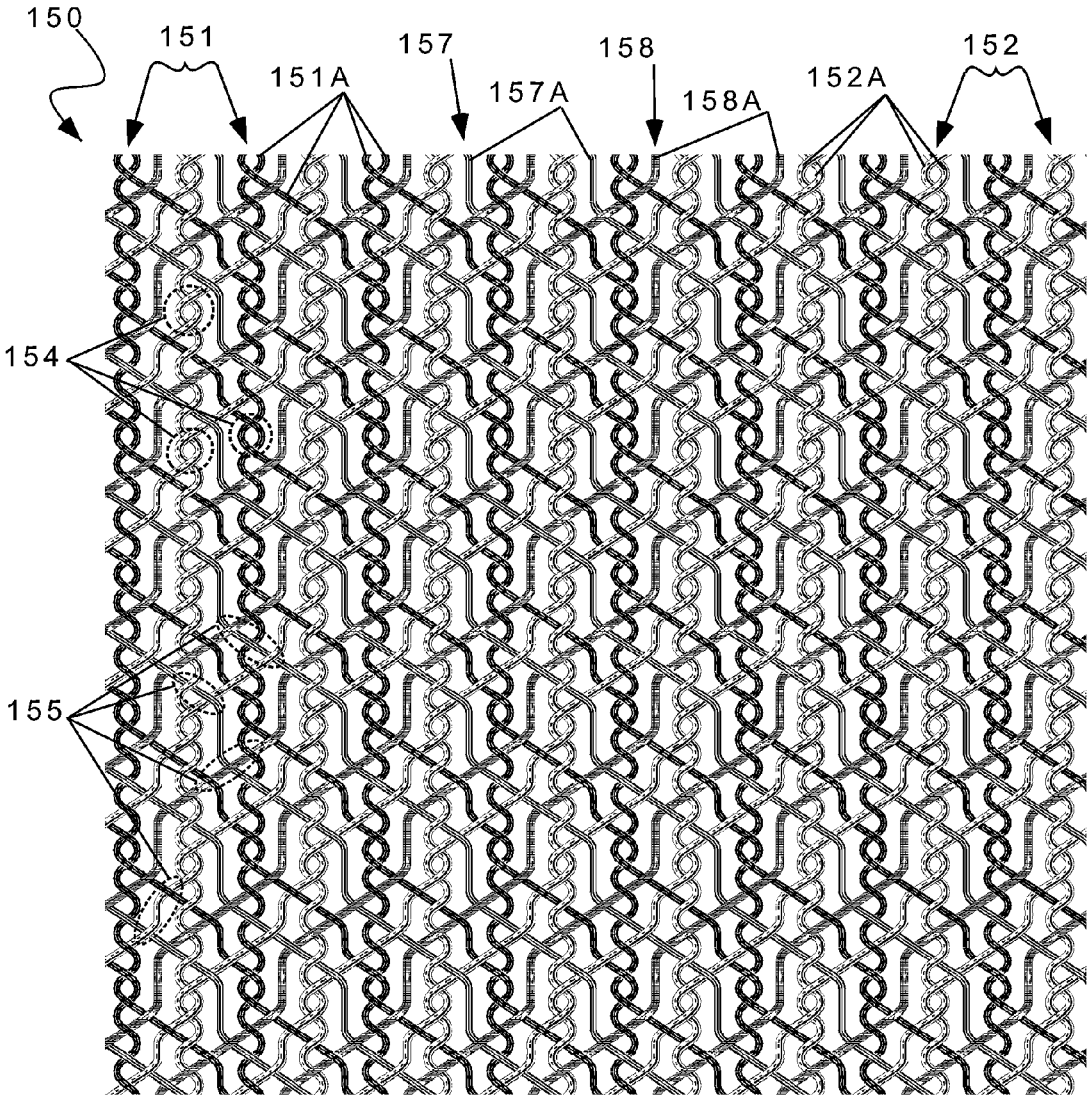
FIG. 15 is a plan view of a patterned plexus of interlaced filaments, which consists of two groups of linked filaments, and two groups of filaments which interlace other groups of filaments, according to one aspect of the present invention.

FIG. 15 is a plan view of an alternative pattern of filaments which lie within the scope of the present invention wherein the plexus of filaments 150 having "linked" and "interlaced" filaments. According to another feature of the present invention, FIG. 15 shows a plexus of filaments 150 which is comprised of a first plurality or group 151 of filaments 151A which are linked 154 together into a unified structure, and a second plurality or group 152 of filaments 152A, which lie adjacent and link to neighboring filaments 152A in group 152. Also shown within the plexus of filaments 150 is a group 157 are adjacent filaments 157A which are not linked to other filaments, yet lie adjacent to the other filaments within group 157, and are interlaced 155 with the opposed groups 152 & 158 of filaments 152A & 158A. Also shown in FIG. 15 is a fourth plurality or group 158 of filaments 158A which lie adjacent to the other filaments 158A within the group 158 but are not linked to adjacent filaments but are interlaced 155 with filaments 151A 7 157A in the group 151 & 157.

The filament structure as shown in FIG. 15 which is comprised of four groups 151, 152, 157 & 158 of filaments, wherein the groups of apposed bisecting interlaced filaments create a singular filament plexus which exhibits characteristics of conformability while retaining desired stiffness and density characteristics.

Figure 16:
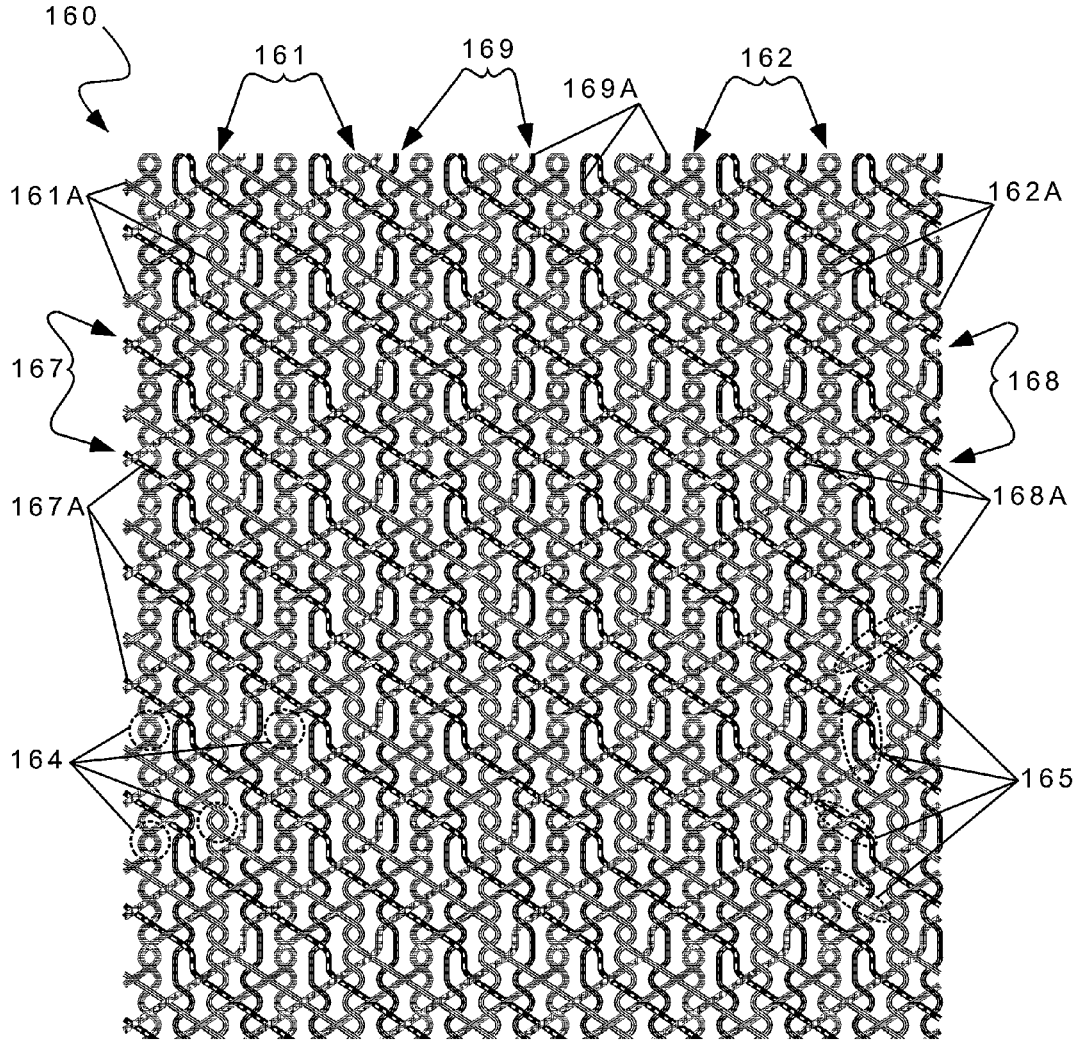
FIG. 16 is a plan view of a patterned plexus of filaments consisting of two groups of linked filaments which interlace, and three other groups of filaments which interlace other groups of filaments, according to one aspect of the present invention.

FIG. 16 is a plan view of another configuration for a plexus of filaments 160 having "linked" and "interlaced" filaments according to another embodiment of the present invention. As shown in FIG. 16, plexus 160 includes two groups 161 & 162 of filaments 161A & 162A, whose members are linked 164 to the neighboring filaments a repetitive amount of times, along the lengths of the filaments 161A & 162A, and whose members travel along paths which bisect each other, and are interlaced 165 with the filaments which lie in the opposed group of filaments. Also shown in FIG. 16 are two other groups 167 & 168 of filaments 167A & 168A which are not linked to the adjacent filaments within their respective groups, but, bisect each other and are interlaced 165 with filaments in bisecting groups of filaments. Also shown within the plexus 160 is a fifth group 169 of filaments 169A which lie adjacent to one another and bisect the other groups 161, 162, 167 & 168 of filaments 161A, 162A, 167A & 168A and are interlaced 166 with the filaments in the groups of filaments 161A, 162A, 167A & 178A.

The plexus 160 of filaments shown in FIG. 16 can be described as providing a "tri-lateral" or "tri-axial" arrangement or plexus of filaments. This aspect of the present invention provides an increase of structural integrity to the plexus 160 while retaining desired characteristics of conformability, pattern stability and plexus density.

Figure 17:
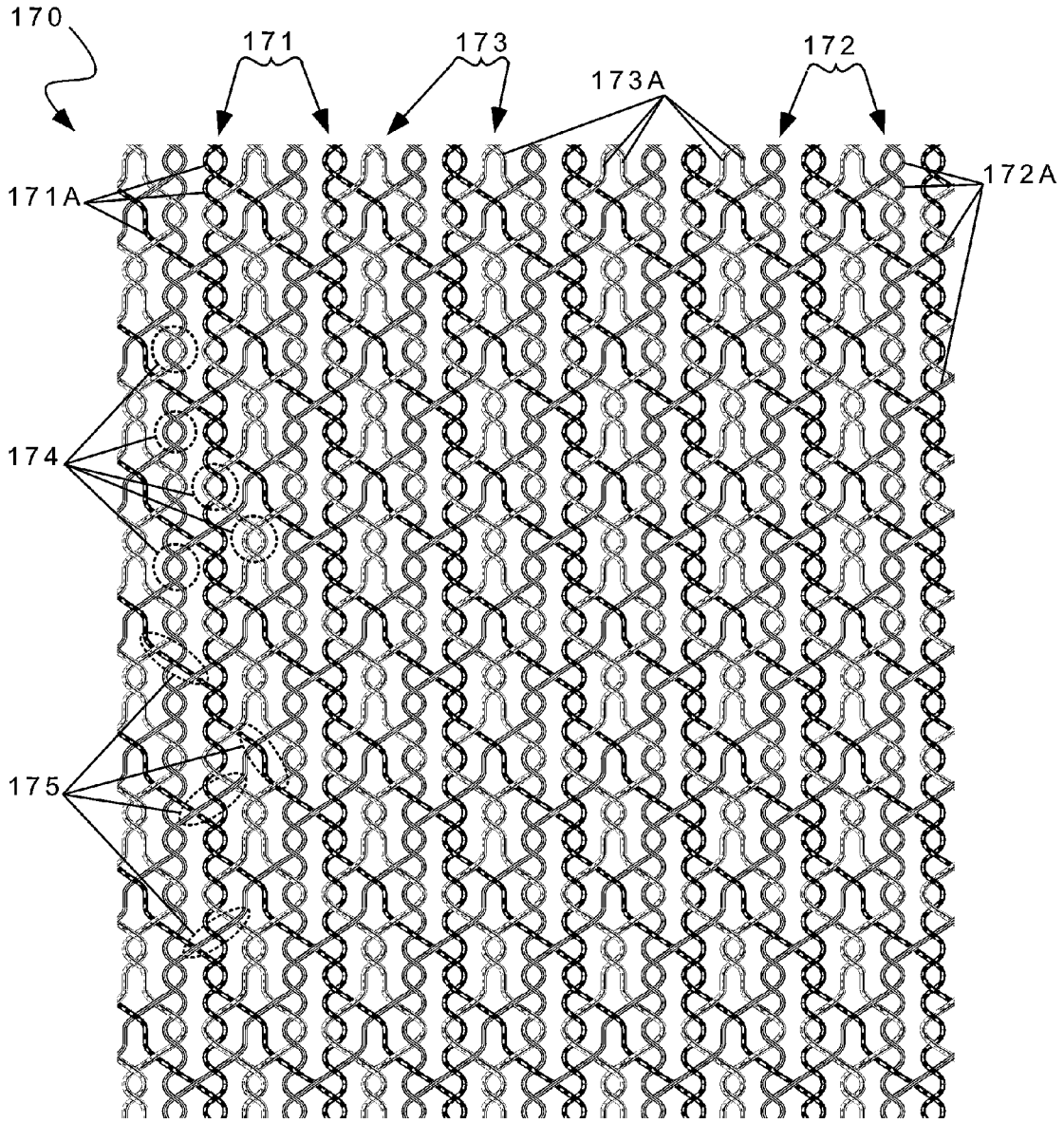
FIG. 17 is a plan view of a patterned plexus of filaments consisting of 3 groups of linked and interlaced filaments, according to one aspect of the present invention.

FIG. 17 is a plan view of another arrangement of filaments 170 having "linked" and "interlaced" filaments according to another facet of the present invention. As shown in FIG. 17, plexus 170 includes a first plurality or group 171 of filaments 171A, which lie adjacent to the other filaments within the group 171 of filaments 171A within the plexus of filaments 170 and are linked 174 to neighboring filaments 171A within the group 171, also shown is a second plurality or group 172 of filaments 172A, which is also comprised of a plurality of filaments 172A, which lie adjacent to the other filaments within the group 172 of filaments 172A, and wherein the filaments 172A are linked 174 to neighboring filaments within the group 172. FIG. 17 also shows that the filaments 171A & 172A within the groups of filaments 171 & 172 are interlaced 175 a plurality of times with the opposed group of filaments, as well as interlaced with a third plurality or group 173 of filaments 173A, which bisect both groups 171 & 172 of filaments 171A & 173A. The third group 173 of filaments 173A also has filaments which lie adjacent to the other filaments within the group 173 of filaments 173A and are linked 174 to neighboring filaments 173A within group 173. Also shown in FIG. 17 is that the group 173 of filaments 173A is also linked 174 with both groups 171 & 172 of filaments 171A & 172A, this facet where all three groups 171, 172 & 173 of filaments 171A, 172A, & 173A are linked together, creates a unified plexus where load and impact forces are distributed throughout the plexus 170 of filaments 171A, 172A, & 173A.

FIG. 17 provides an example of a pattern which may be substantially altered and retain the basic elements as described as the present invention, for instance it would be considered obvious there could be any number of filaments which make up a plexus, or any number of groups of filaments within a plexus, or that a varying number of filaments within a group, could either link to other strands in a group or just interlace with other filaments. These and other basic variations to the herein described family of patterns would not alter the inherent values and abilities of the disclosed present invention, those values being briefly described as tensioned conformability.

Another way of describing an aspect of the present invention as illustrated in FIG. 17 is to describe the paths (lengths) of the filaments 171A, 172A & 173A; as lying along a spiraling path which could be defined as a helix, furthermore as shown in FIG. 17 the helices which filaments create are all linked 174 to one another, in other words all the filaments are linked together creating a singularly tensioned plexus of strands.

To further elaborate upon FIG. 17 it should be noted that the plexus is comprised of three bisecting groups 171, 172 & 173 of adjacent filaments 171A, 172A & 173A, the three groups of filaments together comprise what would be termed a "tri-axial" or a "trilateral" fabric (cloth), tape (webbing) or tubular plexus of filaments. The "trilateral" plexus of filaments may be characterized as providing three axial (or "tri-lateral") or three-or-more-axial restraint or tensioned directions which may provide a more uniformly tensioned plexus, thus enabling a more uniform tension restraining plexus, as well as a stable plexus where filaments are not easily displaced from their patterned locations, thus allowing for a plexus which could be considered valuable to a number of industries, including the automotive, for use in airbags and hoses, and the aviation industry for explosion containment and luggage containment, and the medical industry for stints and flexible organ transplant matrixes.

Figure 18:
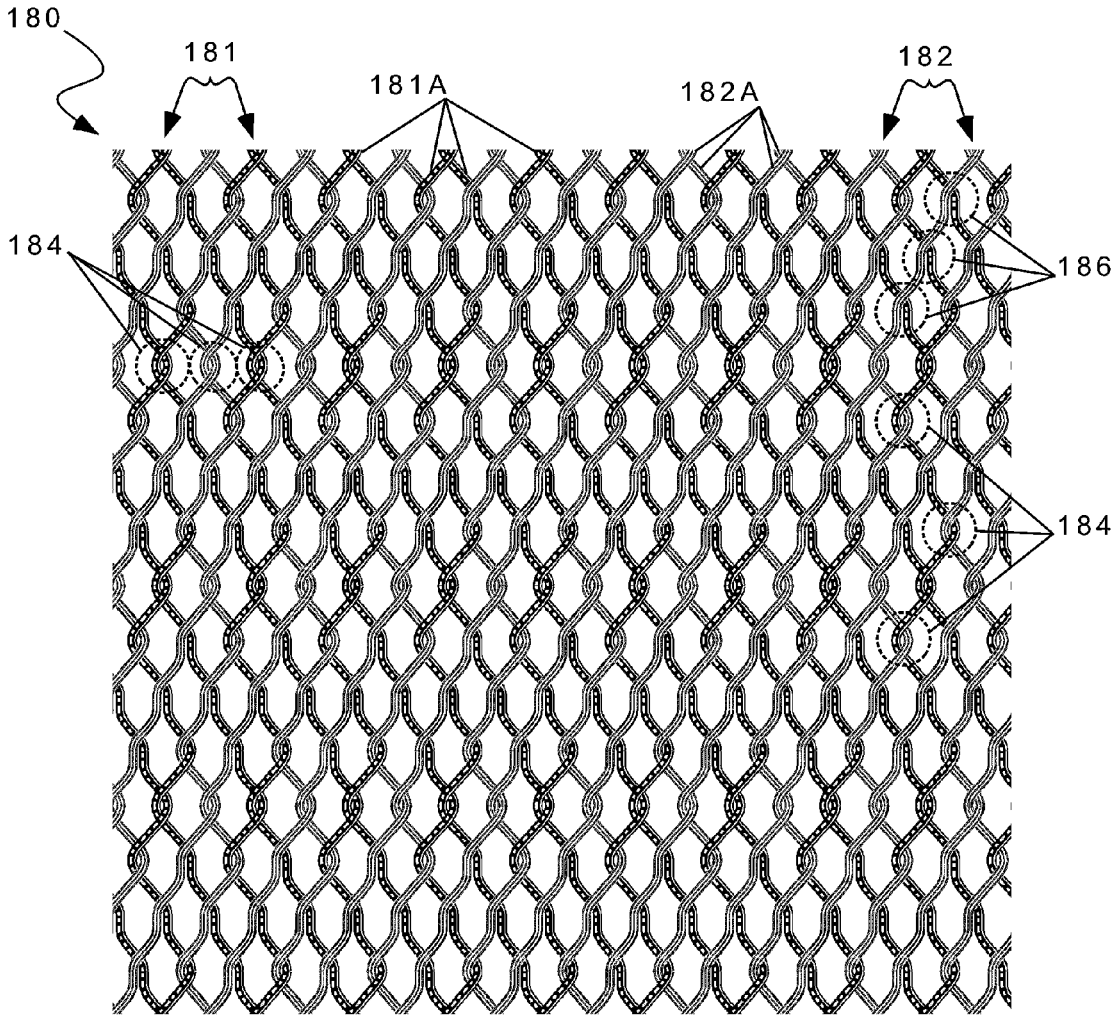
FIG. 18 is a plan view of a patterned plexus of filaments consisting of two groups of linked filaments which bisect each other, according to one aspect of the present invention.

To further illustrate the potentials of the present invention FIG. 18 shows a plexus 180 consisting of two groups 181 & 182 of filaments 181A & 182A, whose members are linked 184 to one another, and bisect 186 the filaments within the opposed group of filaments. Further shown in FIG. 18 are links 184 between the filaments within the two adjacent groups 181 & 182 of filaments 181A & 182A. As shown in FIG. 18 the two bisecting groups 181 & 182 of filaments 181A & 182A pass over, or under, the opposed filaments but are not interlaced with any bisecting 186 filaments 181A or 182A, this is because the bisecting filaments 181A in group 181 pass over top of the bisecting 186 filaments 182A and never underneath any of the bisecting 186 filaments, except when linking 184. The non-interlaced facet of the plexus of filaments 180 allows helices to be formed along the lengths of the strands 181A & 182A whose paths are not interrupted or misshapen by the interlacement with other strands, thus allowing for truer spiraling paths to exist within the linked plexus of filaments. The helices formed by the filaments linking neighboring and bisecting filaments increases the structural integrity of fiber composites, in particular tubular fiber composites, is valuable for specialty applications where greater flexibility is required.

Figure 19:
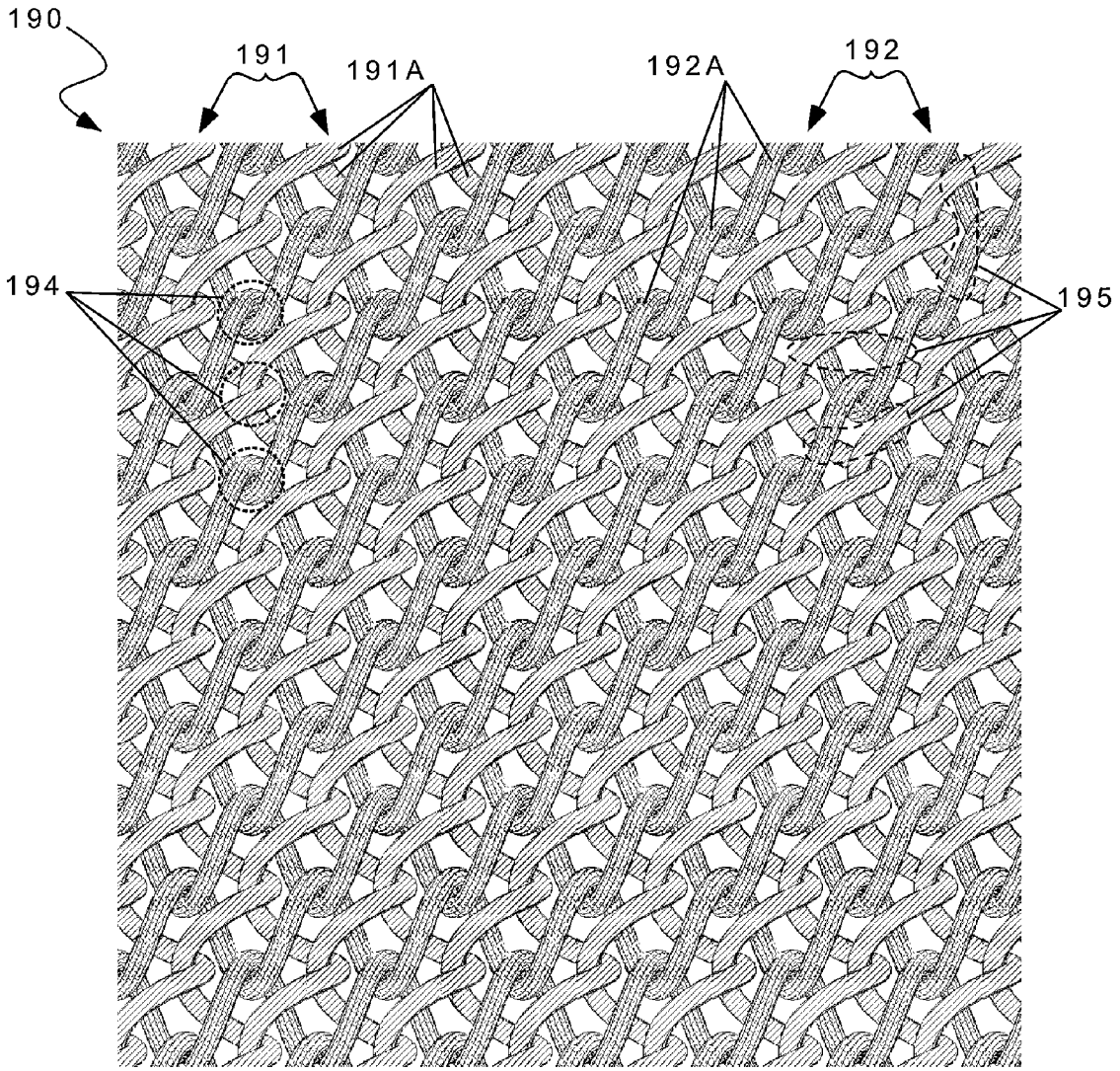
FIG. 19 is a plan view of a patterned plexus of filaments consisting of two groups of linked filaments which interlace each other at perpendicular angles, according to one aspect of the present invention.

FIG. 19 embodies a plexus of filaments 190 with two opposed perpendicular groups 191 &192 of adjacent filaments 191A & 192A, wherein the filaments within each group of filaments link 194 neighboring filaments along their lengths; wherein, the lengths of the filaments are shown to follow spiraling paths, or "helices". The paths that the filaments take in the opposed groups 191 & 192 are interlaced 195 not to individual strands but to whole plexus of the individual groups 191 & 192. The interlacing of the groups 191 & 192 is facilitated by the unification of a group of linked 194 filaments which then function as one interconnected filament structure, subsequently allowing for an interlacement 195 of two filaments from either group, which act as one filament, to another filament from the opposed group of filaments. The linked filament helices as depicted in FIG. 19 create spring like abilities, which allow them to stretch along their length, as each filament helix can constrict its width thus expanding its measured length, this also serves to dampen energy (force) by virtue of each filament having slack built into its length; and by the ability of the filaments to transfer energy, throughout the plexus, through the linked filaments. The slack built into the plexus of spiraling filaments helps absorb impact, through the reduction of velocity, by a filament being readily able to bend from one side of its coil to the other without breaking, thus allowing for the reduction of velocity of force, from impact; by means of imparting tension to force, from a filaments bias to remain stationary. The reduction of velocity of impact by giving to force instead of breaking, is facilitated by filaments within a plexus, as herein disclosed, by linked filaments reducing impact forces upon a portion of a plexus of filaments, by further giving, or paying out their lengths, without breaking, by means of tensional displacement with allows for the "borrowing" of material, or the giving of other filaments throughout the plexus. The generally spiraling paths typifies the paths of the filaments disclosed herein as the present invention and is deemed to be able to not only dampen physical force, but also electrical and vibrational forces as well. The spiraling coils of filaments 191 & 192 would dampen electrical, and similarly, vibrational forces by not only the nature of the coils, but also by the linked filaments which act as vibration dampers by transferring energy to a plurality of other filaments.

Another benefit of a plexus of filaments with substantially coiled filaments lies within the flexibility of the filaments, in particular when disposed within composite structures. Flexible composite structures, particularly tubular structures can be enhanced by the present invention, due general nature of spiraling filaments, which facilitate enhanced flexibility, due to the compressive ability of a coil, which readily bends along its length, due to the ease of compression of the coils on one side of the length of filament, while expanding the coils on the opposed side of the length of a coiled filament.

Figure 20:
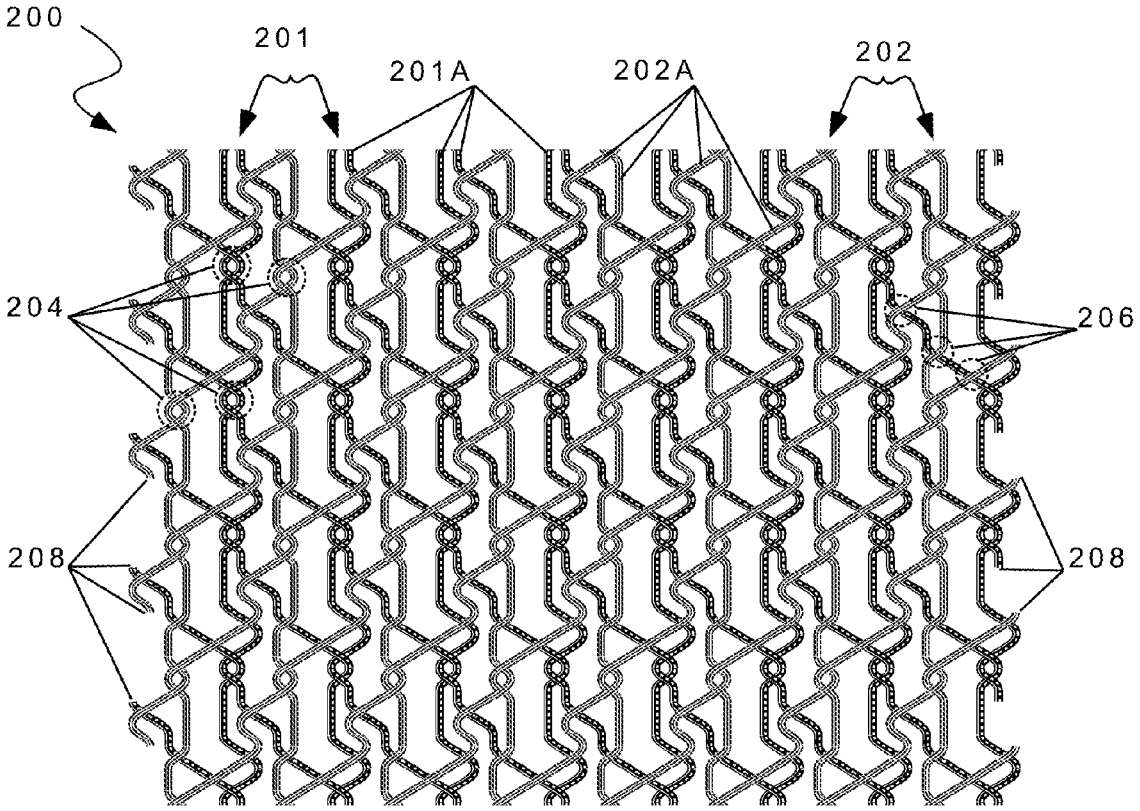
FIG. 20 is a plan view of a patterned plexus of filaments consisting of two groups of linked filaments which bisect, according to one aspect of the present invention.
Figure 20A:
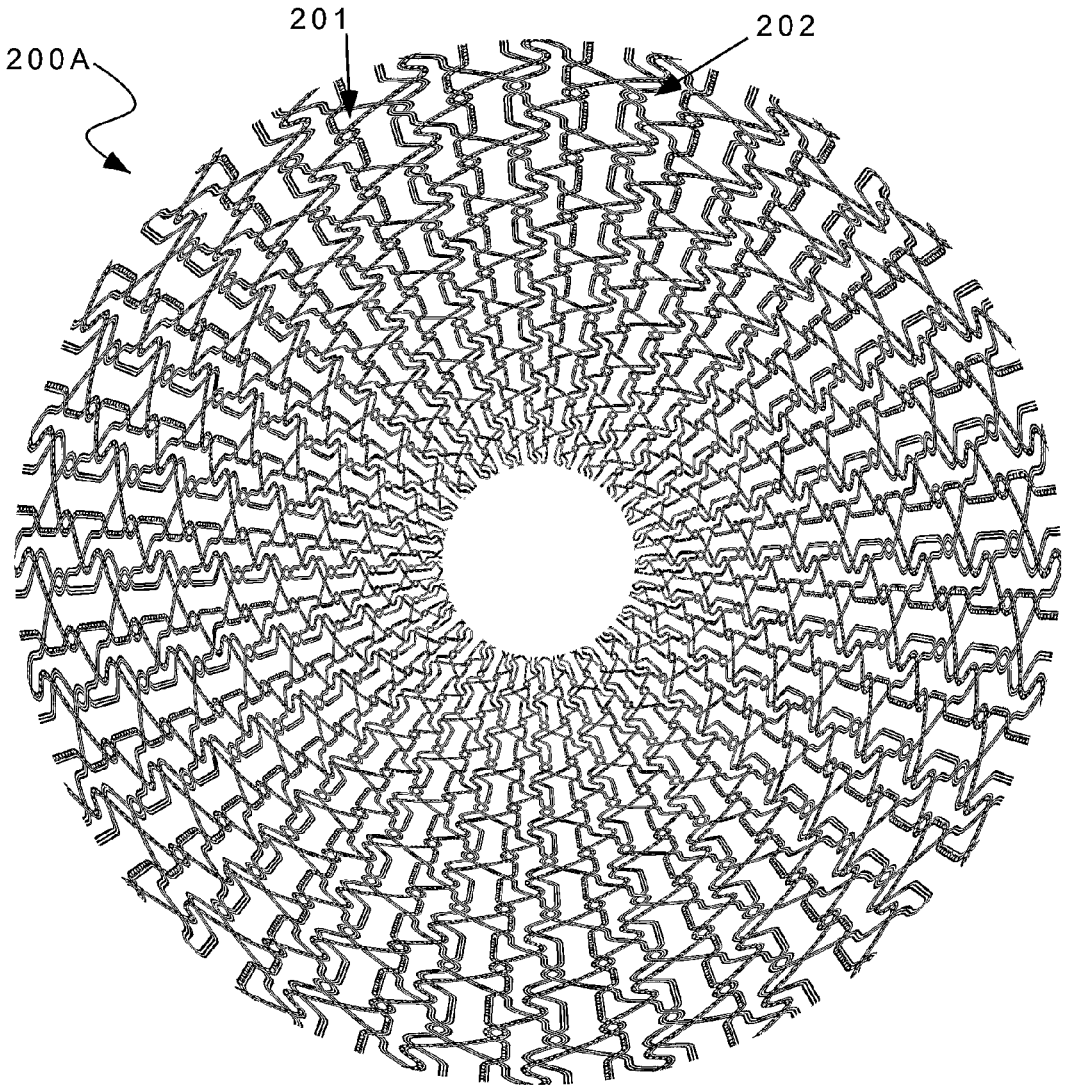
FIG. 20A is a perspective view of a patterned plexus of filaments consisting of two groups of linked filaments which bisect, as shown in FIG. 20.

FIG. 20 is another embodiment of the present invention, which has two groups 201 & 202 of linked 204 adjacent filaments, which bisect 206 each other without interlacing, thereby producing a two layer patterned plexus 200 of filaments, similar as to which would be produced by filaments, traveling upon carriers, following paths programmed into a programmable braiding machine. FIG. 20A shows the same pattern as illustrated in FIG. 20, as it would be produced, into a tubular plexus, by a machine programmed to run the pattern shown in FIG. 20. FIG. 20A is intended to illustrate how a flat pattern, as shown in FIG. 20 by the plexus 200 of filaments 201A & 202A, is read by a braiding machine, and translated into carrier paths, which produce a tubular plexus 200A of filaments. The production of tubular filament arrangements is facilitated by the delivery of the filaments from the carriers, at a programmed rate of speed; a speed of which ultimately defines the density to which a pattern of filaments is produced, and the angle to which the groups of filament lie and bisect each other. FIG. 20 shows two sides of terminal ends 208 of the plexus 210, wherein if terminal ends 208 on either adjacent side were connected; ie. If the pattern were circularly connected, a plexus of filaments would be created as shown in FIG. 20A. It should be noted that any of the patterns shown herein, could be produced as tubular or solid braided filament arrangements, for instance the patterns disclosed as the present invention could be produced upon a programmable solid braider. A solid braider is programmable braiding machine; wherein the carriers which travel upon it, are able to not only move around the circumference of the table to which surface they travel upon, but also across the center, or other radial or diagonal directions to which they are directed. The planer surface of a solid braider which carriers travel upon could be produced in any size or shape, to accommodate any number of carriers.

Figure 21:
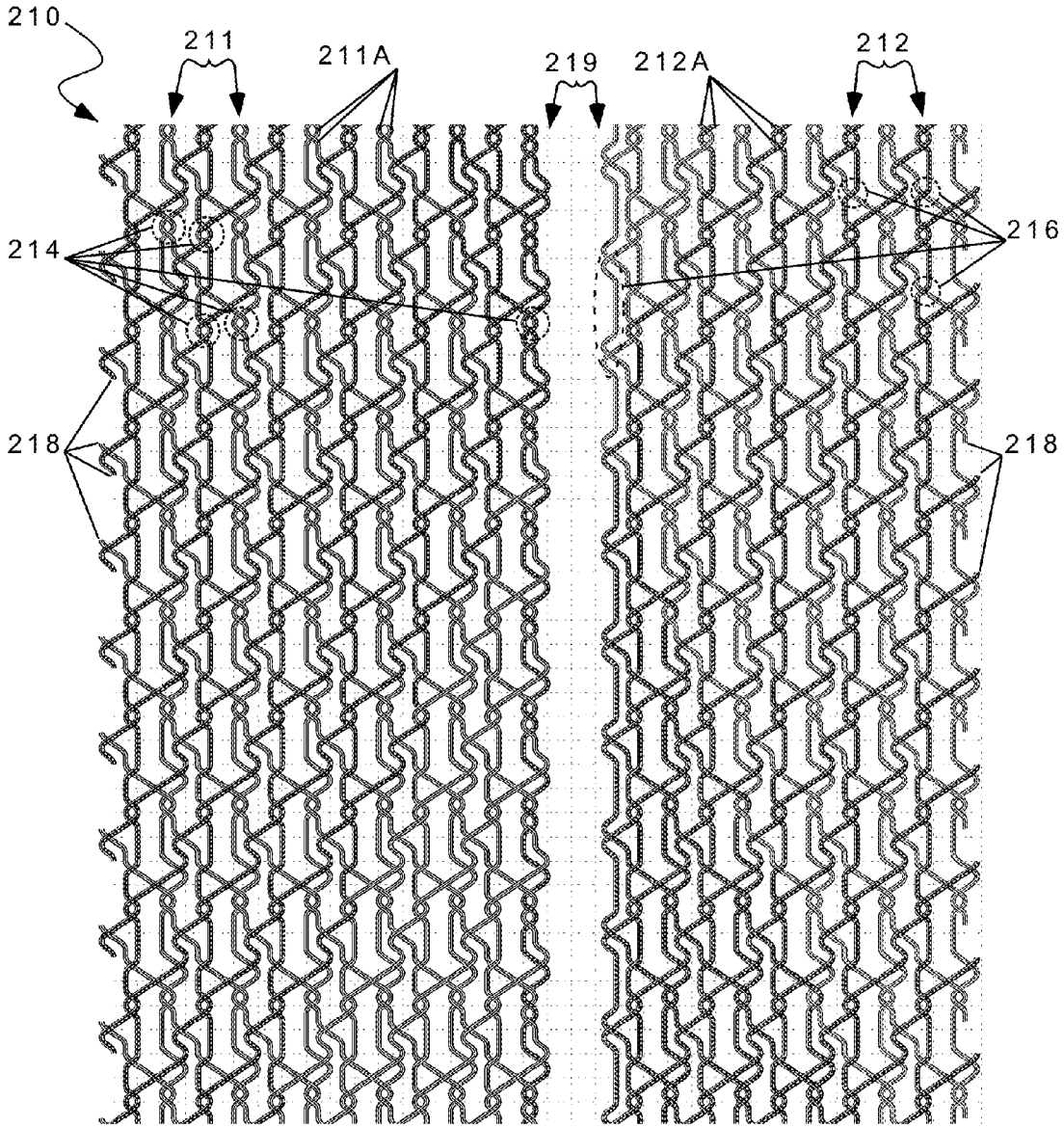
FIG. 21 is a plan view of a patterned plexus of filaments consisting of two groups of linked filaments which bisect and link together, according to one aspect of the present invention.

FIG. 21 shows another aspect of the present invention; wherein a plexus 210 of filaments, which is comprised of two groups 211 & 212 of filaments 211A & 212A, and the filaments which comprise a group of filaments are linked 214 repetitively along their lengths; and wherein the two groups 211 & 212 of filaments 211A & 212A bisect 216 each other repeatedly along the length of the patterned plexus of filaments. FIG. 21 also illustrates how a two layer flat, or concave patterned plexus, whose edges were linked or interlaced, could be produced by a programmable circular braiding machine that followed the pattern shown in FIG. 21. FIG. 21 shows a flat pattern with terminal ends 218 on either adjacent side of the patterned plexus, which would match up, and be read as a continuous circle; much the same as described in FIGS. 20 & 20A, although unlike depicted in FIGS. 20 & 20A, the pattern shown in FIG. 21 shows discontinuous ends 219 within the plexus 210, around the circular paths, which filament carriers would travel, following the pattern shown in FIG. 21. Shown along one edge (left side of center gap) of the length of the plexus of filaments, are links 214, while the other side shows filaments which are interlaced. Between the two edges 219, the bisecting 216 groups 211 & 212 of filaments 211A & 212A are not linked or interlaced, thus creating a two layer plexus of filaments, which are linked and interlaced along either edge 219 of the length of the plexus of filaments. FIG. 21 is also designed to illustrate how the two groups of filaments would bisect each other repetitively by following zig zag paths down the length of the plexus of filaments 210, which is unlike the paths of the groups of filament show in FIGS. 20 & 20A, which would bisect each other repetitively around the length of the radial axis; to which, they spiral down in opposing directions; when being pulled from spools riding on carriers, traveling around the surface a programmable braiding machine.

The filament arrangements described and illustrated above may be fabricated or provided by any conventional or future filament handling device or system. For example, aspects of the invention may be provided by hand or by machinery, for example, automated machinery, such as, programmable automated machines. Aspects of the invention may be provided by automated braiding machines, looms, and/or weaving machines, such as, a programmable automated braiding machine, a programmable automated loom, or programmable automated weaving machine. In one aspect, filament structures as disclosed herein may be made with programmable lace braiding machines.

In addition to the footwear shown in FIGS. 1A through 1C, it will be appreciated by those in the art that aspects of the present invention may be adapted for use in a broad range of fields where fiber arrangements or plexus of fibers can be employed. Aspects of the present invention include articles and the application to these articles of filament arrangements as disclosed herein, for example, to provide enhanced properties to the articles. These fields to which aspects of the invention may be applied include, but are not limited to, footwear, apparel, sportswear, accessories, sporting goods, fiber-reinforced materials. Aspects of the invention may be applied to aerospace materials, structures, devices, apparel, and accessories; automotive materials, structures, devices, apparel, and accessories; military materials, structures, devices, apparel, and accessories; medical materials, structures, devices, apparel, and accessories; energy conservation materials, structures (including wind turbines), apparel, and accessories; robotics; and manufacturing devices, among other fields.

It will be recognized that aspects of the invention may be uniquely applicable for structural applications for retaining or resisting loading, for example, impact loading, shock loading, and/or explosions. It is understood that the filament arrangements provided according to aspects of the invention can provide a network for absorbing, dissipating, and/or containing loads, in particular loads of brief or short term duration, such as, impact, shock, and/or explosion loading. Accordingly, aspects of the invention may be uniquely applicable to military applications, for example, for use in armor or shielding; in aerospace applications, for use in aircraft and space craft, for instance, in engines, such as, in jet engine shrouds; and use in automotive applications, for example, for use in engines, panels, airbags, and bumpers. Other applications of aspects of the invention for absorbing, dissipating, and/or containing loads will be apparent to those in the art.

With regard to footwear, one or more of the filament arrangements disclosed herein may be employed to enhance the performance and/or durability of any footwear to which aspects of the present invention can be applied. For example, dress shoes, work shoes, and sport shoes. With regard to sport shoes, aspects of the present invention may be used to fabricate running shoes, basketball shoes, training shoes (including "wraps"), football shoes, baseball shoes, softball shoes, soccer shoes (e.g., "boots"), skateboarding shoes, golf shoes, tennis shoes, ski boots, hockey skates, weightlifting shoes, and climbing shoes, among other sport shoes. Accordingly, aspects of the present invention may comprise a sport shoe having one or more of the filament, or family of filament arrangements disclosed herein. For example, aspects of the present invention include a running shoe, a basketball shoe, a baseball shoe, a training shoe, a football shoe, a soccer shoe, a golf shoe, and a tennis shoe, among the other sport shoes listed above, having one or more of the filament arrangements disclosed herein, for instance one or more of the filament arrangements fabricated with a automated programmable braiding machine as disclosed herein.

With regard to apparel, one or more of the filament arrangements disclosed herein may be employed to enhance the performance and/or durability of any form of clothing (for example, non-sports-wear-related clothing) to which aspects of the present invention can be applied. For example, shirts, t-shirts, sweaters, sweatshirts (including "hoodies"), jackets, ties, coats, shorts, pants, capris, tights, leggings, skirts, blouses, yoga wear, under wear (including undershirts, underpants, undershorts, bras, compression garments (for example, braces, and sleeves) and socks), hats, and caps. For example, aspects of the present invention include a shirt, a jersey, a sweatshirt, a jacket, shorts, and underwear, among the other form of clothing listed above, having one or more of the filament arrangements disclosed herein, for instance, one or more of the filament arrangements fabricated with a automated programmable braiding machine as disclosed herein, and a method for fabricating each piece of apparel listed above.

With regard to sportswear, one or more of the filament arrangements disclosed herein may be employed to enhance the performance and/or durability of any form of sportswear to which aspects of the present invention can be applied. For example, shirts, t-shirts, jerseys, tank tops, sweaters, sweatshirts (including "hoodies"), jackets, vests, shorts, pants, capris, tights, leggings, skirts, blouses, swimwear, under wear (including "base wear," undershirts, underpants, undershorts, bras, and socks). For example, aspects of the present invention include a shirt, a jersey, a sweatshirt, a jacket, shorts, and underwear, among the other sports wear listed above, having one or more of the filament arrangements disclosed herein, for instance, one or more of the filament arrangements fabricated with a automated programmable braiding machine as disclosed herein, and a method for fabricating each piece of sportswear listed above.

With regard to accessories, one or more of the filament arrangements disclosed herein may be employed to enhance the performance and/or durability of any form of accessory to which aspects of the present invention can be applied. For example, hats, caps, gloves (including baseball mitts (including catcher's mitts) batting gloves, workout gloves, and boxing gloves, among others), bags, packs, backpacks, blankets, towels, sweat bands, and, among other accessories. For example, aspects of the present invention include a hat, a glove, a bag, a pack, a blanket, and a sweat band, among the other accessories listed above, having one or more of the filament arrangements disclosed herein, for instance, one or more of the filament arrangements fabricated with a automated programmable braiding machine as disclosed herein, and a method for fabricating each accessory listed above.

With regard to sporting goods, one or more of the filament arrangements disclosed herein may be employed to enhance the performance and/or durability of any sporting good to which aspects of the present invention can be applied. In one aspect, the invention comprises a sporting good having one or more of the filament arrangements disclosed herein. For example, one or more of the filament arrangements can be used to enhance the strength, performance, and/or durability of a golf club, a baseball bat, a tennis racket, a hockey stick (both field hockey stick and ice hockey stick), among other sports implements. Accordingly, aspects of the present invention may comprise a golf club having one or more of the filament arrangements disclosed herein, a baseball bat having one or more of the filament arrangements disclosed herein, a tennis racket having one or more of the filament arrangements disclosed herein, and a hockey stick having one or more of the filament arrangements disclosed herein, for instance, one or more of the filament arrangements fabricated with an automated programmable braiding machine as disclosed herein, and a method for fabricating each sporting good listed above.

In another aspect, the invention comprises a sporting ball or projectile having one or more of the filament arrangements disclosed herein. For example, one or more of the filament arrangements can be used to enhance the strength, performance, and/or durability of a golf ball, a baseball, a football, a soccer ball, a tennis ball, a hockey puck or ball, a volley ball, and a rugby ball, among other sports equipment implements. Accordingly, aspects of the present invention may comprise a golf ball having one or more of the filament arrangements disclosed herein, a baseball having one or more of the filament arrangements disclosed herein, a football having one or more of the filament arrangements disclosed herein, a soccer ball having one or more of the filament arrangements disclosed herein, a tennis ball having one or more of the filament arrangements disclosed herein, a hockey puck or ball having one or more of the filament arrangements disclosed herein, a volleyball having one or more of the filament arrangements disclosed herein, and a rugby ball having one or more of the filament arrangements disclosed herein, for instance, one or more of the filament arrangements fabricated with an automated programmable braiding machine as disclosed herein, among other sports balls that can be enhanced by aspects of the present invention, and a method for fabricating each ball or projectile listed above.

Aspects of the present invention may also be applied to protective gear for example, military gear, police gear, fire protection gear, first responder gear, industrial protection gear, construction protection gear, laboratory protection gear, and aerospace protection gear (including flight suits and space suits). For example, in addition to sporting goods as discussed above, aspects of the present invention may be incorporated into and enhance the performance of any form of protective gear. For instance, aspects of the invention also include protective shirts, pants, jackets, suits, hats, gloves, masks, helmets, and enclosures, having any one or more of the filament structures disclosed herein, for instance, one or more of the filament arrangements fabricated with an automated programmable braiding machine as disclosed herein, and a method for fabricating each protective gear listed above.

Aspects of the present invention may also be applied to the field of fiber re-enforced materials, or "composite" materials. For example, in addition to sporting goods as discussed above, but also any structural or non-structural element that can be enhanced with the addition of any one or more of the filament structures disclosed herein, for instance, one or more of the filament arrangements fabricated with an automated programmable braiding machine as disclosed herein. For instance, aspects of the invention include automotive structures, such as, panels, braces, beams, supports, and the like, and a method for fabricating each fiber-reinforced material or structure listed above.

Aspects of the present invention may also be applied to wires, cabling, rope, and/or cord which may be enhanced with the application of any one or more of the filament structures disclosed herein, for instance, one or more of the filament arrangements fabricated with an automated programmable braiding machine as disclosed herein.

As described herein, and in contrast to the prior art, aspects of the present invention provide footwear structures that can address the limitations of the prior art. Specifically, aspects of the present invention provide enhanced means of securing the upper to the sole while minimizing the separation of the upper from the foot of the wearer. This is most evident in the capability of tensioning the arch region of the upper to better conform to the foot, but also is evident in the engagement of the upper and the sole by means of conformable filament structures. In addition to comfort, engagement of the upper with the sole according to aspects of the invention can provide a more structural secure engagement, for example, by filament structures that avoid the perpendicular engagement of the upper with the sole that characterizes the prior art. Accordingly, aspects of the present invention can minimize or prevent separation or prevent the rips and tears that characterize the engagement of the upper and sole in the prior art. Also described herein, and in contrast to the prior art is an integral lace system expedites or eliminates the manufacturing process of having to thread the laces thru the eyelets designed accommodate typical shoe laces. Further descriptions relating to shoe laces describe laces circumventing the heel of a shoe and returning to the top of the foot laced portion of the shoelaces being able to then be tied or otherwise bound ensuring a greater ability to tension a shoe around a heel, to a user's foot. The variety of methods of lacing a shoe can be expedited by either braiding the shoe laces into the pattern used to create a shoe upper as described herein or by being able to efficiently and effectively replace filaments braided into the pattern of a shoe which act as temporary laces and could be used to tie to and draw permanent laces thru eyelets or holes within the patterned plexus of filaments which is designed to allow laces to properly tension the filament plexus around a user's foot.

As disclosed herein aspects of the present invention provides improved filament arrangements having enhanced performance and durability that can be applied to a broad range of fields. Though aspects of the invention may be uniquely suited for the fabrication of footwear, it will be clear to those of skill in the art that aspects of the invention provide advantages to at least the broad range of fields and applications identified above. Other fields and applications of use will be apparent to those skilled in the art.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

I claim:

1. A plexus of filaments, comprising;

a filament pattern within an area of said plexus of filaments wherein said filament pattern consists of two or more groups of filaments;

wherein within each of said two or more groups, all filaments traverse adjacent spiraling paths, and;

wherein within said filament pattern each of said at least two groups of filaments traverse paths at opposed axial angles to each other, and;

wherein two filaments within a group of filaments create a link by partially wrapping each other, and;

wherein within at least one of said two or more groups of filaments, at least one individual filament links an individual first neighboring filament on one side of said spiraling path and subsequently traverses to and links to an individual second neighboring filament on the other side of said spiraling path, resulting in said at least one individual filament traversing in a repetitive spiraling path by linking to said individual first and second neighboring filaments repetitively along either side of said at least one individual filament's overall length.

2. A plexus of filaments as recited in claim 1, wherein within said filament pattern, at least one filament within each group of filaments cross under and over at least one filament within each of the other groups of filaments.

3. A plexus of filaments as recited in claim 2, wherein said filament pattern consists of, two groups of filaments, and;

wherein within each group at least one filament is repetitively linked along its length with immediately adjacent filaments.

4. A plexus of filaments as recited in claim 3, wherein within said filament pattern, said two groups of filaments travel extensively along perpendicular paths.

5. A plexus of filaments as recited in claim 2, wherein said filament pattern consists of two groups of filaments, and;

wherein within each group, all the filaments are repetitively linked along their length with other filaments within their group of filaments.

* * * * *